US012060881B2

(12) United States Patent
Lucas et al.

(10) Patent No.: US 12,060,881 B2
(45) Date of Patent: Aug. 13, 2024

(54) POSITIVE DISPLACEMENT ROOTS BLOWER NOISE SUPPRESSION

(71) Applicant: Ingersoll-Rand Industrial U.S., Inc., Davidson, NC (US)

(72) Inventors: Michael J. Lucas, Mooresville, NC (US); Gautier Lombart, Hangest en Santerre (FR); Christian Doucet, St-Lazare (CA); Thomas Gholami-Zouj, Linselles (FR)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

(21) Appl. No.: 17/525,133

(22) Filed: Nov. 12, 2021

(65) Prior Publication Data

US 2022/0145885 A1 May 12, 2022

Related U.S. Application Data

(60) Provisional application No. 63/112,981, filed on Nov. 12, 2020.

(51) Int. Cl.
*F03C 2/00* (2006.01)
*F03C 4/00* (2006.01)
(Continued)

(52) U.S. Cl.
CPC ..... *F04C 18/126* (2013.01); *F04C 25/00* (2013.01); *F04C 29/0035* (2013.01); *F04C 29/06* (2013.01); *F04C 2240/20* (2013.01)

(58) Field of Classification Search
CPC .... F04C 18/126; F04C 25/00; F04C 29/0035; F04C 29/06; F04C 29/122; F04C 2240/20
See application file for complete search history.

(56) References Cited

U.S. PATENT DOCUMENTS 2,489,887 A * 11/1949 Houghton ..... F04C 29/042 418/86
4,185,664 A 1/1980 Zabsky et al.
(Continued)

FOREIGN PATENT DOCUMENTS

FR 1121079 A 7/1956

OTHER PUBLICATIONS

Sun, Shu-Kai et al., "Numerical study and experimental validation of a Roots blower with backflow design," Engineering Applications of Computational Fluid Mechanics, 2018, vol. 12, No. 1. pp. 282-292, Downloaded Jan. 5, 2018.
(Continued)

*Primary Examiner* — Theresa Trieu
(74) *Attorney, Agent, or Firm* — Kevin E. West; Advent, LLP

(57) ABSTRACT

A positive displacement roots blower can include a housing having an inlet structured to receive an incoming flow of a fluid, an outlet structured to receive an outgoing flow of the fluid, and a passage. The positive displacement roots blower can also include a pair of intermeshed rotating members supported for complementary rotation within the housing, where the rotating members and the housing form respective operating volumes there between which rotate with the rotating members. Each of the respective operating volumes has the following regions: (1) open to inlet/closed to outlet; (2) closed to inlet/closed to outlet; and (3) closed to inlet/open to outlet. The passage includes a restriction and connects to at least one of the operating volumes when the at least one of the respective operating volumes is in region (2). The restriction can be a venturi feedback connecting to the outlet.

20 Claims, 24 Drawing Sheets

(51) Int. Cl.

| | |
|---|---|
| ***F04C 2/00*** | (2006.01) |
| ***F04C 18/00*** | (2006.01) |
| ***F04C 18/12*** | (2006.01) |
| ***F04C 25/00*** | (2006.01) |
| ***F04C 29/00*** | (2006.01) |
| *F04C 29/06* | (2006.01) |

(56) References Cited

U.S. PATENT DOCUMENTS

| | | | | |
|---|---|---|---|---|
| 4,215,977 | A * | 8/1980 | Weatherston | F04C 29/0035 418/180 |
| 5,090,879 | A * | 2/1992 | Weinbrecht | F04C 29/122 418/180 |
| 5,702,240 | A | 12/1997 | O'Neal et al. | |
| 6,099,277 | A * | 8/2000 | Patel | F04C 18/126 418/206.4 |
| 6,203,297 | B1 | 3/2001 | Patel | |
| 6,312,240 | B1 * | 11/2001 | Weinbrecht | F04C 29/122 418/206.4 |
| 9,151,292 | B2 | 10/2015 | Huang et al. | |
| 10,851,788 | B2 | 12/2020 | Lucas et al. | |
| 2012/0195783 | A1 * | 8/2012 | Fitzpatrick | F04C 29/0035 418/180 |
| 2015/0361982 | A1 | 12/2015 | Huang et al. | |
| 2017/0241327 | A1 * | 8/2017 | Mendler, III | F04C 29/04 |
| 2020/0200178 | A1 | 6/2020 | Lucas et al. | |

OTHER PUBLICATIONS

Extended European Search Report for Application No. 21208039.4, dated Jun. 2, 2022.

* cited by examiner

POSITIVE DISPLACEMENT ROOTS BLOWER NOISE SUPPRESSION

CROSS-REFERENCE TO RELATED APPLICATIONS

The present application claims the benefit under 35 U.S.C. § 119(e) of U.S. Provisional Application Ser. No. 63/112,981, filed Nov. 12, 2020, and titled "POSITIVE DISPLACEMENT ROOTS BLOWER NOISE SUPPRESSION," which is herein incorporated by reference in its entirety.

BACKGROUND

Roots-type blowers, also referred to as roots blowers are positive displacement pumps that pump fluid through a pair of engaging rotors.

DRAWINGS

The Detailed Description is described with reference to the accompanying figures. The use of the same reference numbers in different instances in the description and the figures may indicate similar or identical items.

DETAILED DESCRIPTION

Figure 1:
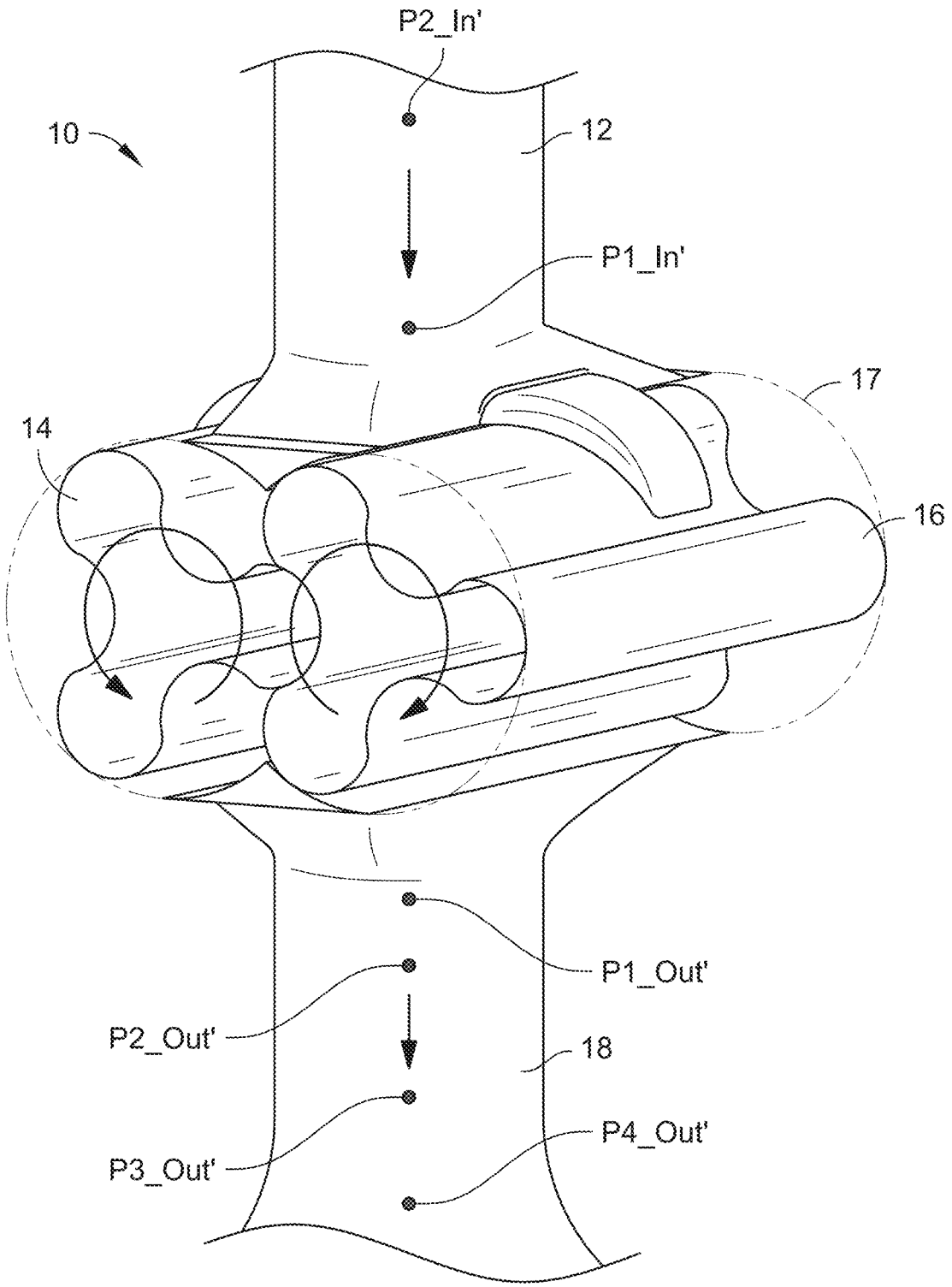
FIG. 1 is a partial cross-sectional perspective view illustrating a positive displacement blower, with test points for a computational fluid dynamics (CFD) model for evaluating pressure overlayed on the blower.

For the purposes of promoting an understanding of the principles of the subject matter, reference will now be made to the examples illustrated in the drawings and specific language will be used to describe the same. It will nevertheless be understood that no limitation of the scope of the subject matter is thereby intended. Any alterations and further modifications in the described examples, and any further applications of the principles of the subject matter as described herein are contemplated as would normally occur to one skilled in the art to which the subject matter relates.

Referring generally to FIGS. 1 through 16, positive displacement roots blowers are described. A roots blower is one form of a positive displacement compressor that can be operated as an air compressor or as a vacuum pump. Roots blowers are easier to manufacturer than a screw compressor, less expensive, and more robust (tolerant) to the ingestion of debris that sometimes enters the compressor. Roots blowers find many applications in industry because they are oil-free compressors. Some of the applications for roots blowers are in the food processing industries, wastewater treatment plants, pumping dry goods into tanker trucks, and vacuum pumps used in street cleaners.

One of the main problems with roots blowers is the noise they produce. A significant portion of the package size and cost are the silencers to make the operation of the blower acceptable in the workplace or in the community. Rapid opening of the trapped pocket at the discharge is the cause for these pulsations. Because the rotors are a two-dimensional profile extruded into the third dimension (aligned with the axis of rotation), the rotors open the trapped pocket instantaneously causing a sudden change in pressure at the discharge that is the noise source.

As described herein, positive displacement roots blowers in accordance with the present disclosure reduce the pressure pulsations at the discharge of the positive displacement roots blowers. The systems, techniques, and apparatus of the present disclosure use one or more venturi feedback loops to raise the pocket pressure from inlet to the current discharge pressure. For example, the inlet pressure is less than the discharge pressure, and often the inlet pressure is at atmospheric pressure and the discharge pressure is near 1 bar gage. In example embodiments, the pocket pressure is increased from atmospheric pressure to about 1 bar atm when moving from a position open to the inlet and closed to the venturi feedback loop and the outlet, to a position open to the outlet and closed to the inlet and the venturi feedback loop.

The systems, techniques, and apparatus herein can be described as a feedback loop created by the venturi from discharge to pocket. The feedback loop makes it possible for the pocket to equalize before opening completely to the discharge. This equalization process reduces pressure pulsations significantly.

The pocket pressure is timed by the size of the venturi so that when the pocket closes at the inlet the venturi begins to raise the pocket pressure to equal the discharge pressure. When the pocket opens at the discharge, these two pressures are nearly the same and as a result the pressure pulsation is significantly reduced.

The venturi typically is not in a sonic condition nor do the systems, techniques, and apparatus described herein necessarily operate the nozzle as a sonic nozzle. Instead, the venturi acts as a throttle to gradually let air into the pocket so the pressure does not suddenly change inside the pocket, defeating the purpose of reducing the pressure pulsations at the discharge.

With reference to FIG. 1, a positive displacement roots blower 10 without a venturi feedback loop is illustrated having an inlet 12 structured to provide a fluid to a pair of intermeshed rotors 14 and 16, forming a pocket of fluid, the joint rotation of which in turn delivers the fluid to the outlet 18 for discharge from the blower 10. The pair of intermeshed rotors 14 and 16 are located within a housing 17. In some forms the rotors 14 and 16 include a two-dimensional cross-sectional profile which is then extruded along a third dimension (aligned with the axis of rotation). The roots blower 10 is structured to pull fluid from the inlet 12 and drive it toward the outlet 18.

During a rotation sequence the rotors 14 and 16 are structured to capture a pocket of fluid from the inlet 12 and rotate the pocket to a position to expose the pocket to the outlet 18 to complete the process from inlet 12 to outlet 18. The pocket is trapped between lobes of each respective rotor and a surface of the housing which encloses the rotors. The formation of pressure pulsations can occur at the discharge of the positive displacement roots blower.

Referring now to FIGS. 2 through 16, positive displacement roots blowers having one or more venturi feedback loops are described in accordance with examples of the present disclosure. In some examples, a positive displacement roots blower can be operated in a configuration where the inlet is at atmospheric pressure and the discharge is connected to a pressurized tank. In some examples, the roots blower can be operated in a configuration where the inlet is at less than atmospheric pressure (e.g., at vacuum pressure), and the discharge is at atmospheric pressure. As described, a discharge silencer may no longer be needed, and, if an operator wants a very quiet running machine, the size of the silencer may be reduced. In some examples, power may be increased by using a roots blower with one or more venturi feedback loops, e.g., by about 5% when compared to a roots blower without venturi feedback loops. The systems, techniques, and apparatus of the present disclosure may be particularly well suited to applications where noise and weight are critical factors.

Figure 2:
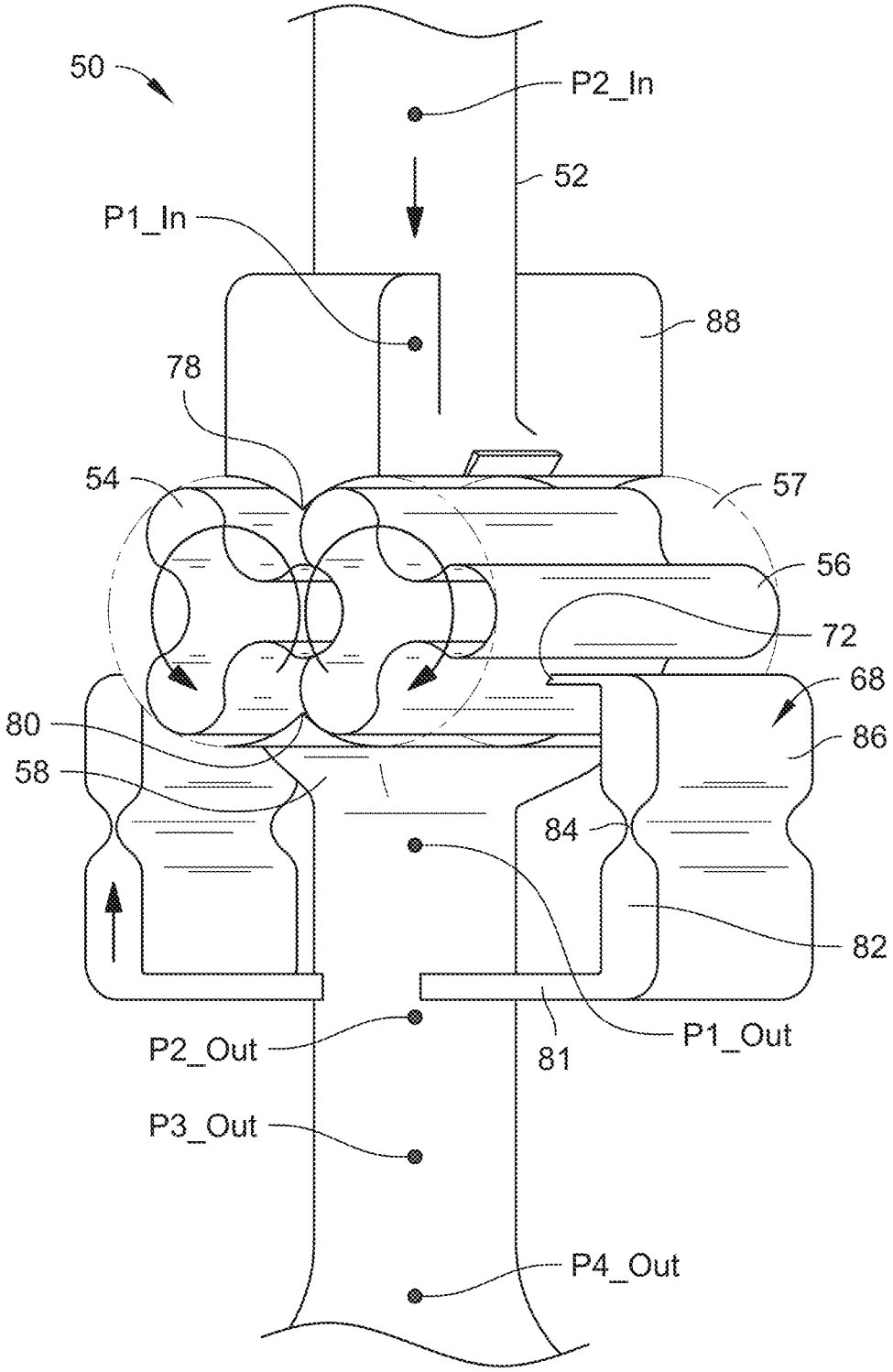
FIG. 2 is a partial cross-sectional perspective view illustrating a positive displacement roots blower having venturi feedbacks in accordance with examples of the present disclosure, where test points for a CFD model for evaluating pressure are overlayed on the roots blower.

As used herein, descriptions which refer to clock positions (e.g. "6 o'clock") will be understood to be a clock position relative to the rotor 56 depicted in FIG. 2, in which the rotor is rotating in the clockwise direction as viewed from the perspective of FIG. 2. It will be appreciated that the rotor 54 rotates in a counter-clockwise direction, in which mirror images of the clock positions can be easily determined. The 12 o'clock position will be understood as the position determined by first drawing a reference line between the inlet side intersection 78 of the arc path swept by the rotor 54 and rotor 56 and the outlet side intersection 80 of the arc path swept by the rotor 54 and rotor 56. A secondary line is then drawn orthogonal to the reference line which represents the 3 o'clock-9 o'clock clock axis. A clock reference line is then drawn orthogonal from the secondary line and offset from the reference line, in which the clock reference line is drawn to locate the top most and bottom most part of the arc that the rotor 56 travels through. Although reference will be made herein to clock positions relative to rotor 56, it will be understood that straightforward transformations can be made to determine appropriate clock positions of the rotor 54.

In lieu of clock positions, reference may also be made herein using angular measurements. It will be appreciated that such angular measurements can either be absolute or relative measurements depending on the context, where the absolute angular measurements are referenced starting from the 12 o'clock positioned as determined above and which progresses in a clockwise direction. To set forth just a few non-limiting examples, 12 o'clock is the same as 0 degrees; 3 o'clock is the same as 90 degrees; 6 o'clock is the same as 180 degrees, etc.

The roots blower 50 has an inlet 52 and an outlet 58, e.g., as described with reference to FIG. 2. The rotors 54 and 56 opening and then closing trap a pocket of air that is then transported to the outlet 58. The accumulation of air continuously added at the outlet increases the discharge pressure. The trapped pocket created by the opening and closing of the rotors is typically at atmospheric pressure. However, with a positive displacement machine, the built-in pressure ratio is the main factor used to determine how much change in pressure the blower will produce. The change in pressure is the difference between discharge and inlet. Though the illustrated example depicts respective rotors 54 and 56 each having three lobes, other examples can have a different number of lobes. For example, some examples can include four or five lobed rotors.

FIG. 2 shows two venturi feedbacks 68, one on either side of the blower that feed air from the outlet 58 to the pocket. The venturi feedbacks 68 connect the outlet 58 of the roots blower 50 to the housing 57 surrounding the rotors 54 and 56 through a venturi feedback inlet 72. In accordance with present examples, the venturi feedback 68 may connect the discharge at around the 4 o'clock position of the housing 57, but other starting positions are contemplated herein. Additionally, in some examples there is an air reservoir 88 positioned proximate to the blower inlet. Since the pocket has little time for air to feed into the pocket as the rotors 54 and 56 turn to move the pocket, air from the air reservoir 88 is available when the pocket opens. In examples of the disclosure, the size and dimension of the air reservoir 88 may be equal to or greater than the pocket that will open and be filled. Both features can provide a reduction in the pressure pulsations.

A venturi as described herein is a tube having a venturi ingress for incoming flow, a venturi egress for outgoing flow, and a tapering, constricted section between the venturi ingress and the venturi egress, where there is a smooth transition between the venturi ingress and the constricted section and between the constricted section and the venturi egress. The constricted section of the venturi may be positioned at a midpoint between the venturi ingress and the venturi egress or may be closer to one of the venturi ingress or the venturi egress. The tube forming the venturi has a first cross-sectional area (e.g., as a function of diameter for a circular tube) at the venturi ingress, a second cross-sectional area (e.g., as a function of diameter for a circular tube) at the constricted section, and a third cross-sectional area (e.g., as function of diameter for a circular tube) at the venturi egress, where the second cross-sectional area or tube diameter at the constricted section is smaller than the first and third cross-sectional areas or tube diameters at the venturi ingress and the venturi egress respectively. The first tube cross-sectional area or diameter at the venturi inlet may be smaller than, equal to, or greater than the third tube cross-sectional area or diameter at the venturi egress. However, the second tube cross-sectional area or diameter is smaller than the first and third cross-sectional areas or tube diameters. A venturi works on the principle of the Venturi Effect, which corresponds to the reduction in fluid pressure that results when the fluid flows through the constricted section of the tube. As the pressure of the fluid passing through the constricted section decreases, its velocity increases. As the flow leaves the constricted section of the tube, the velocity of the flow decreases as its pressure increases once again. A venturi tube may include more than one constricted section for restricting the flow of the fluid passing through the venturi feedback.

FIG. 2 shows venturi feedbacks 68 having a venturi ingress 82, a constricted section 84, and a venturi egress 86. Venturi ingress 82 is connected to outlet 58 through a connecting tube 81. Venturi egress 86 is connected to the inside of the housing 57 through venturi inlet 72.

Figure 3:
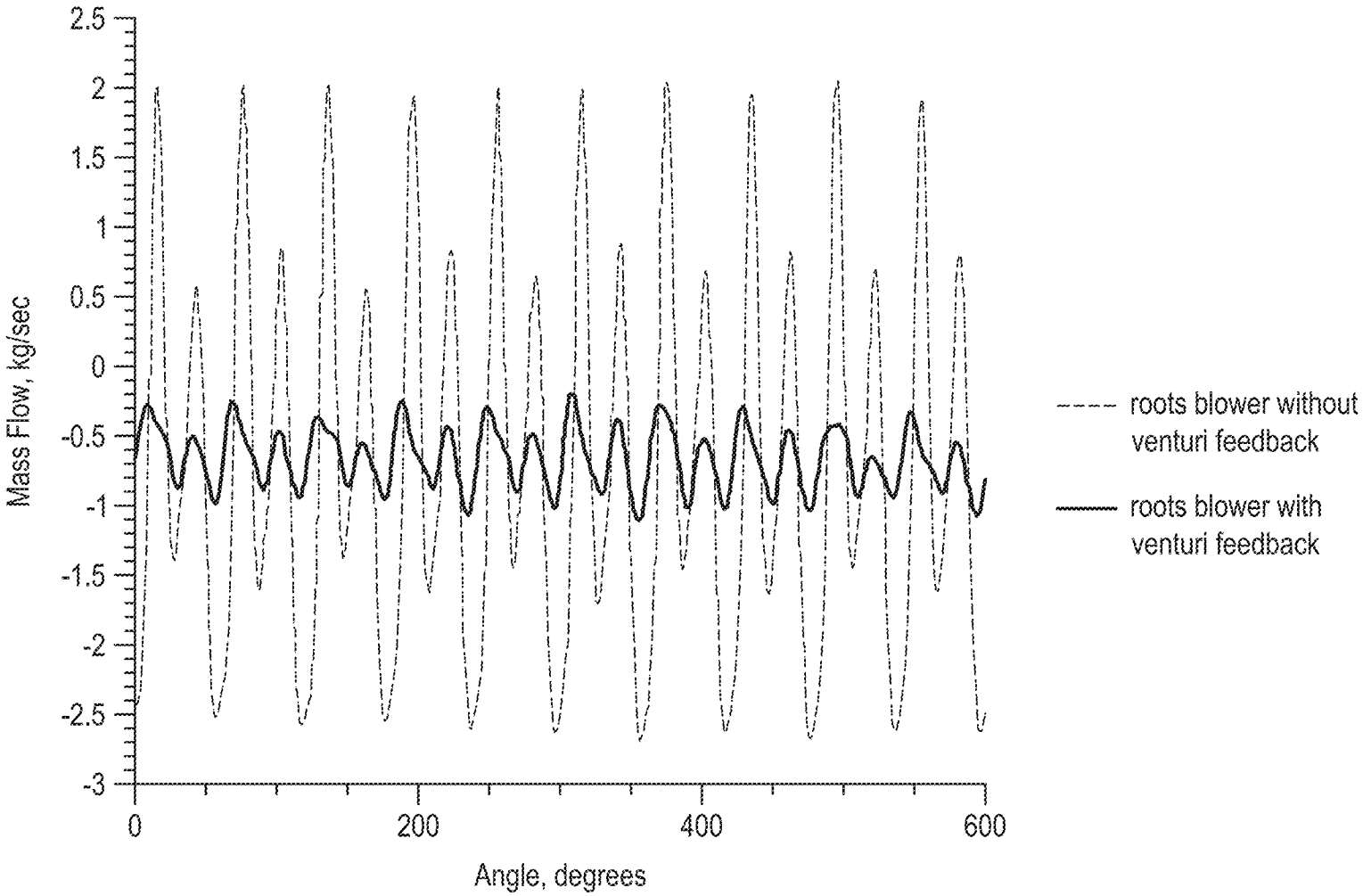
FIG. 3 is a graph illustrating mass flow in kilograms per second (kg/sec) versus angle in degrees showing a comparison of mass flow rates between the positive displacement blower illustrated in FIG. 1 and the positive displacement roots blower illustrated in FIG. 2, respectively.

Referring now to FIG. 3, the mass flow rate for a roots blower without a venturi feedback loop is compared to the mass flow rate for a roots blower with venturi feedback loops as described herein. As shown, the mass flow rate of the roots blower without the venturi feedback loop has both a positive and a negative flow direction, while the roots blower with the venturi feedback loop as described herein discharges air consistently in one direction. Additionally, the peak-to-peak amplitudes of the mass flow rate of the roots blower without the venturi feedback loop are extreme when compared to the amplitudes of the roots blower with the venturi feedback loop. The venturi feedback(s) make a significant difference in how the compressor operates. The positive displacement roots blowers with venturi feedback loops as described herein can run smoothly with a steady air output streaming out at a uniform rate. In contrast, the roots blower without the venturi feedback loop sucks and blows air with each rotation of the rotors, increasing the noise and pressure pulsations of the system. Finally, FIG. 3 show that the average mass flow rate of the two designs is not necessarily affected by the addition of the venturi feedback loop.

Figure 4:
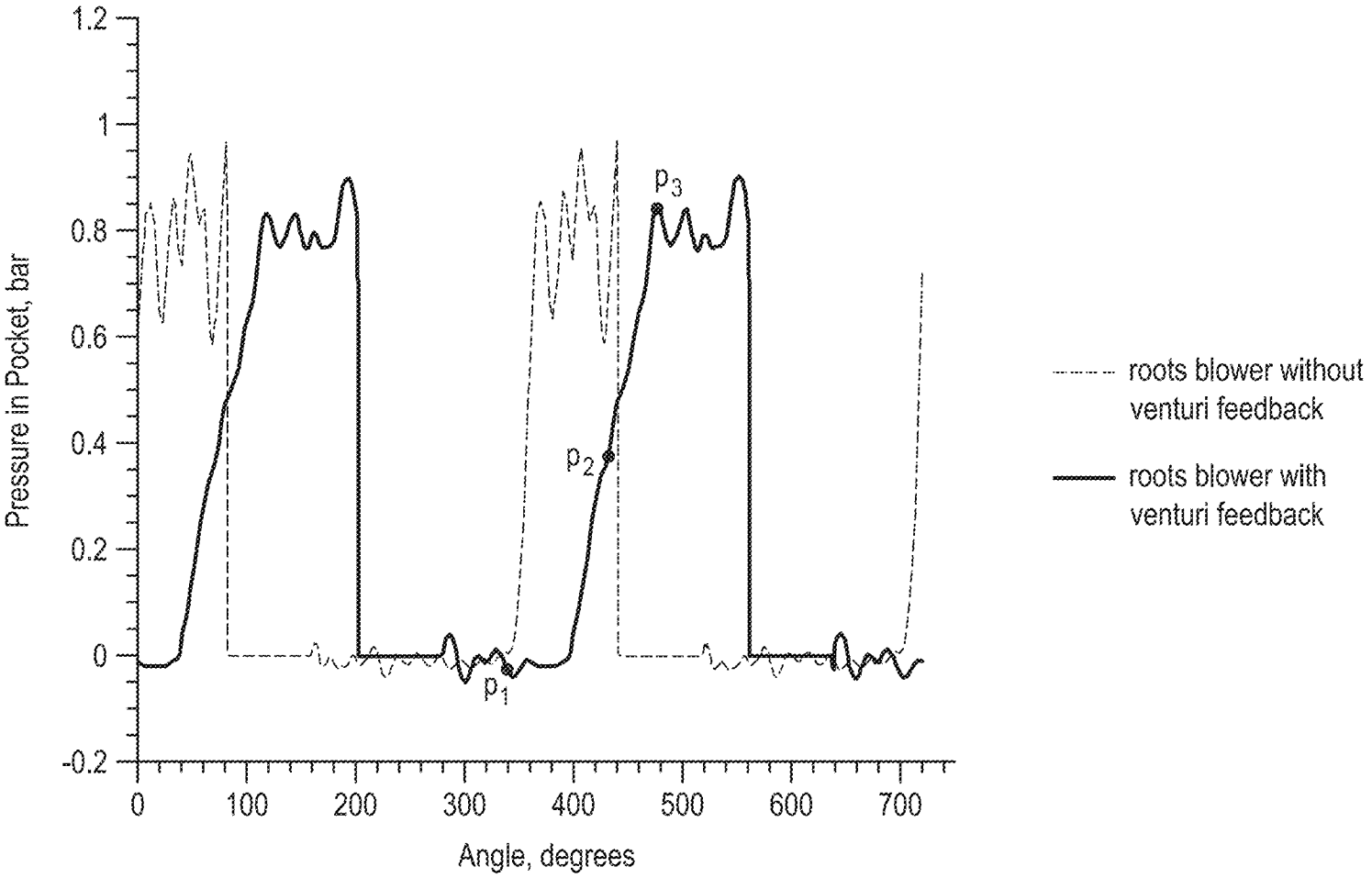
FIG. 4 is a graph illustrating pocket pressure in bars versus angle in degrees showing a comparison of pocket pressures between the positive displacement blower illustrated in FIG. 1 and the positive displacement roots blower illustrated in FIG. 2, respectively.

With reference to FIG. 4, pocket pressure during rotation is described. Different stages of pocket pressure as a pocket is opened, closed, and then discharged are shown. The dashed line shows the pocket pressure of a roots blower without a venturi feedback loop. The pressure in the pocket remains at the inlet pressure until the pocket is opened to the higher discharge pressure. The process of opening causes the pocket pressure to rapidly increase, which is the cause for the pressure pulsation in a roots blower without a venturi feedback loop. The solid line shows the pressure in the pocket of the roots blower with a venturi feedback loop as described herein. As shown, $p_1$ shows a pressure when the pocket is open to the atmosphere. The venturi feedback loop gradually increases the pocket pressure as the pocket rotates from inlet 52 to outlet 58, until it nearly equals with the discharge pressure. In the accompanying graph, point $p_2$ shows an intermediate pressure as the pocket rotates from inlet 52 to outlet 58. Finally, point $p_3$ shows the pressure fluctuations inside the pocket as it opens to the outlet 58. The closer the pressure of the pocket is to the discharge pressure prior to opening to the outlet, the lower the pressure pulsation is at the discharge of the compressor.

Figure 5:
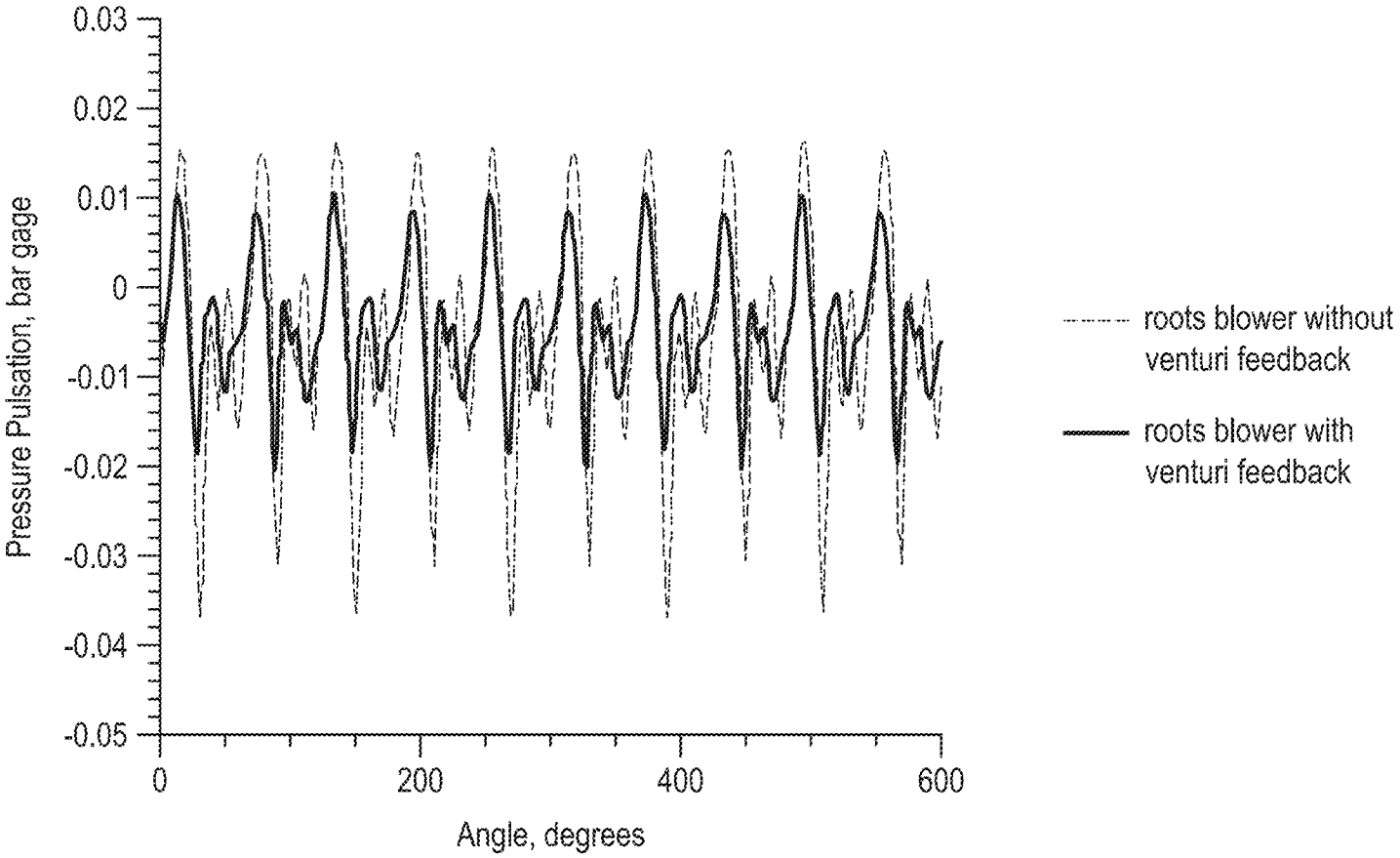
FIG. 5 is a graph illustrating pressure pulsation in bars gage versus angle in degrees showing a comparison of inlet dynamic pressures at points P1_In' and P1_In for the positive displacement blower illustrated in FIG. 1 and the positive displacement roots blower illustrated in FIG. 2, respectively.
Figure 6:
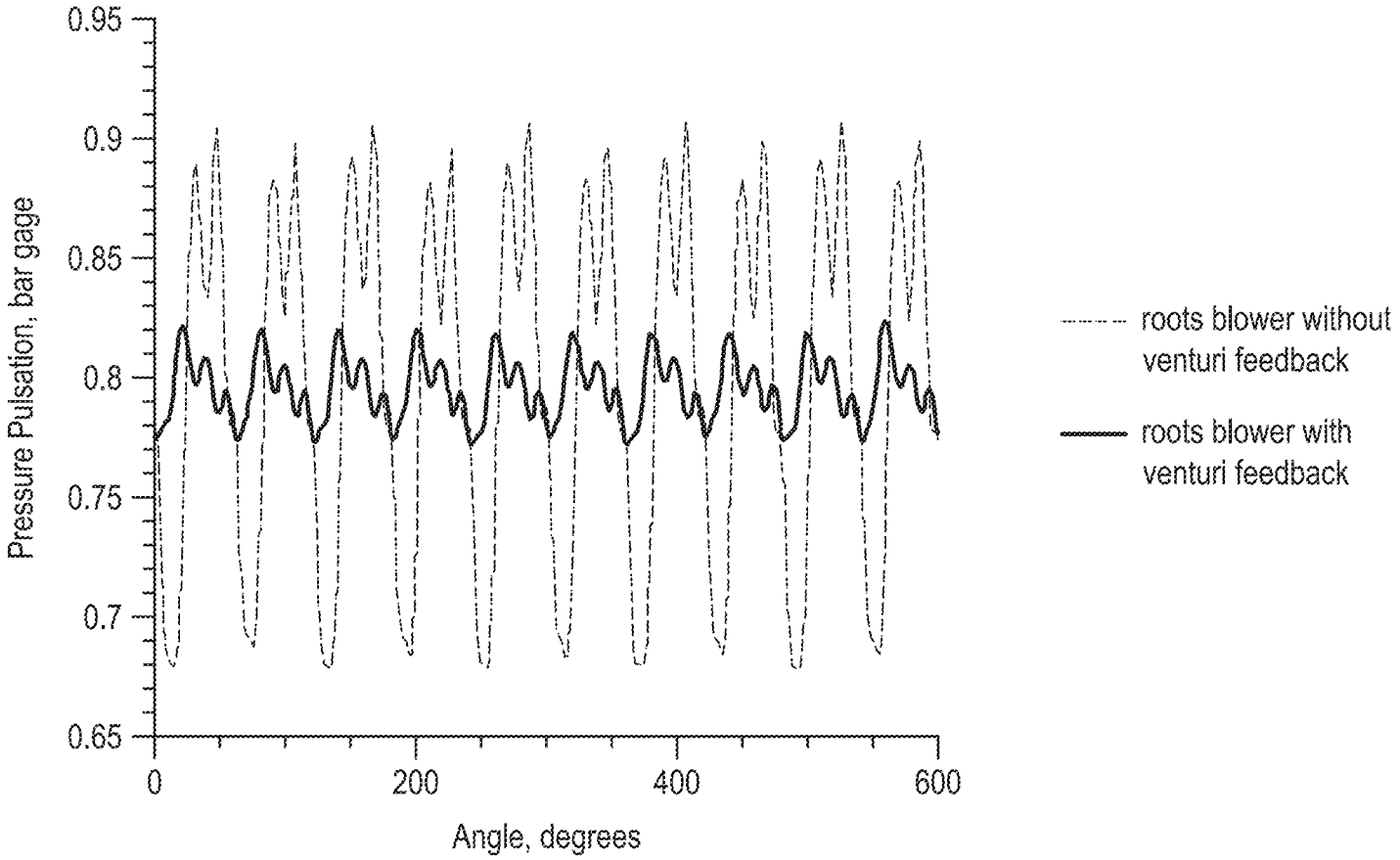
FIG. 6 is a graph illustrating pressure pulsation in bars gage versus angle in degrees showing a comparison of outlet dynamic pressures at points P1_Out' and P1_Out for the positive displacement blower illustrated in FIG. 1 and the positive displacement roots blower illustrated in FIG. 2, respectively.
Figure 7:
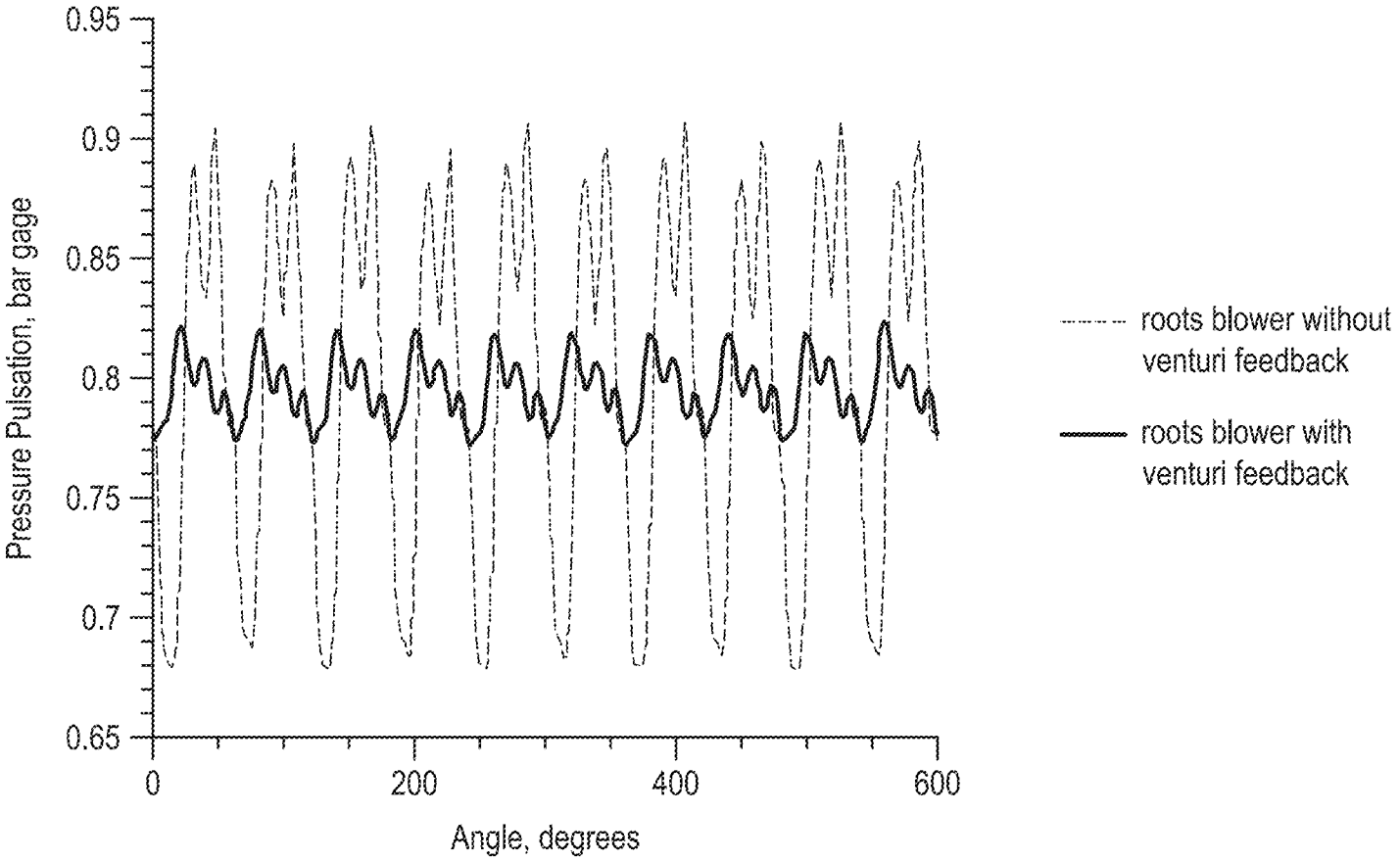
FIG. 7 is a graph illustrating pressure pulsation in bars gage versus angle in degrees showing a comparison of outlet dynamic pressures at points P2_Out' and P2_Out for the positive displacement blower illustrated in FIG. 1 and the positive displacement roots blower illustrated in FIG. 2, respectively.
Figure 8:
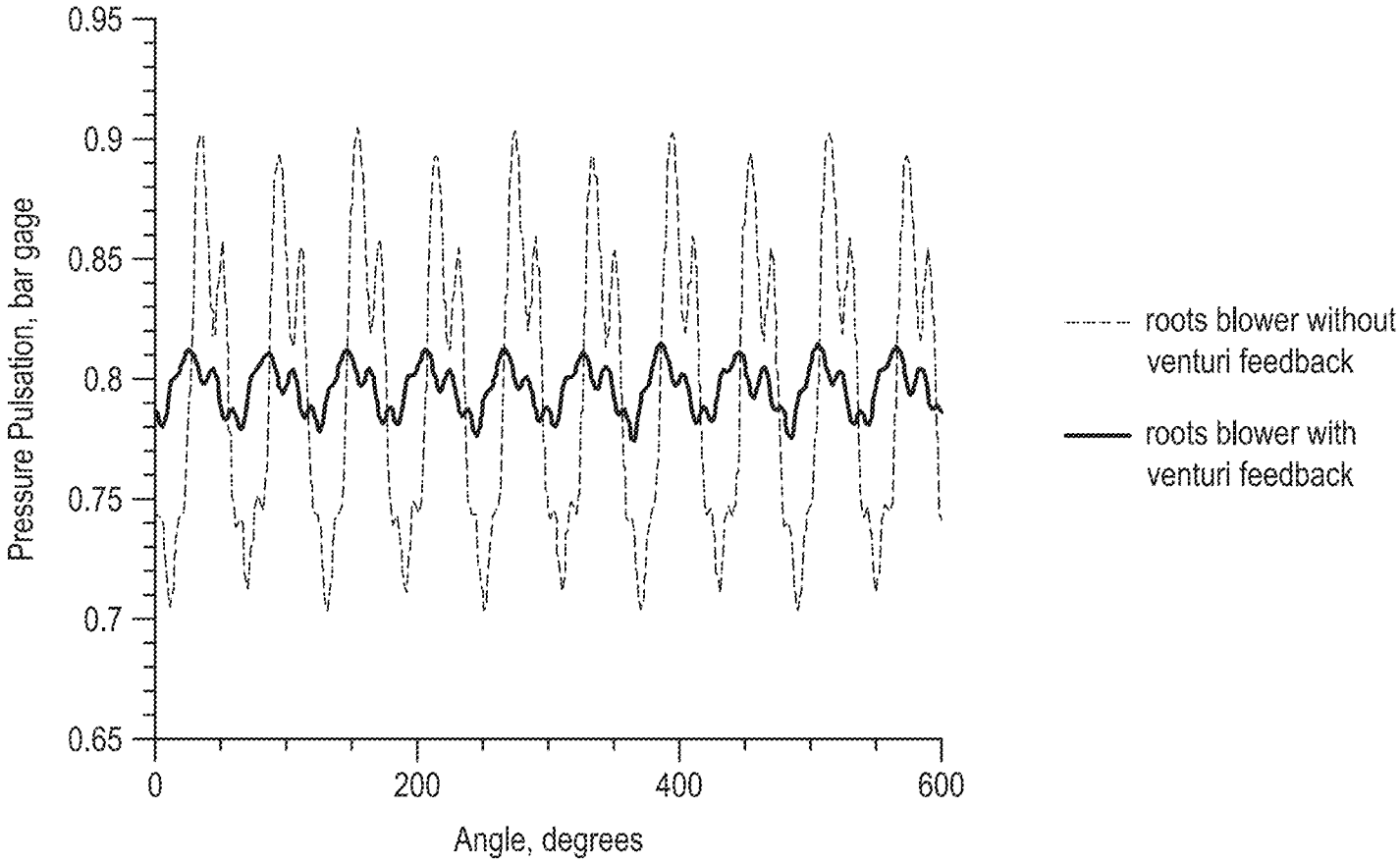
FIG. 8 is a graph illustrating pressure pulsation in bars gage versus angle in degrees showing a comparison of outlet dynamic pressures at points P3_Out' and P3_Out for the positive displacement blower illustrated in FIG. 1 and the positive displacement roots blower illustrated in FIG. 2, respectively.
Figure 9:
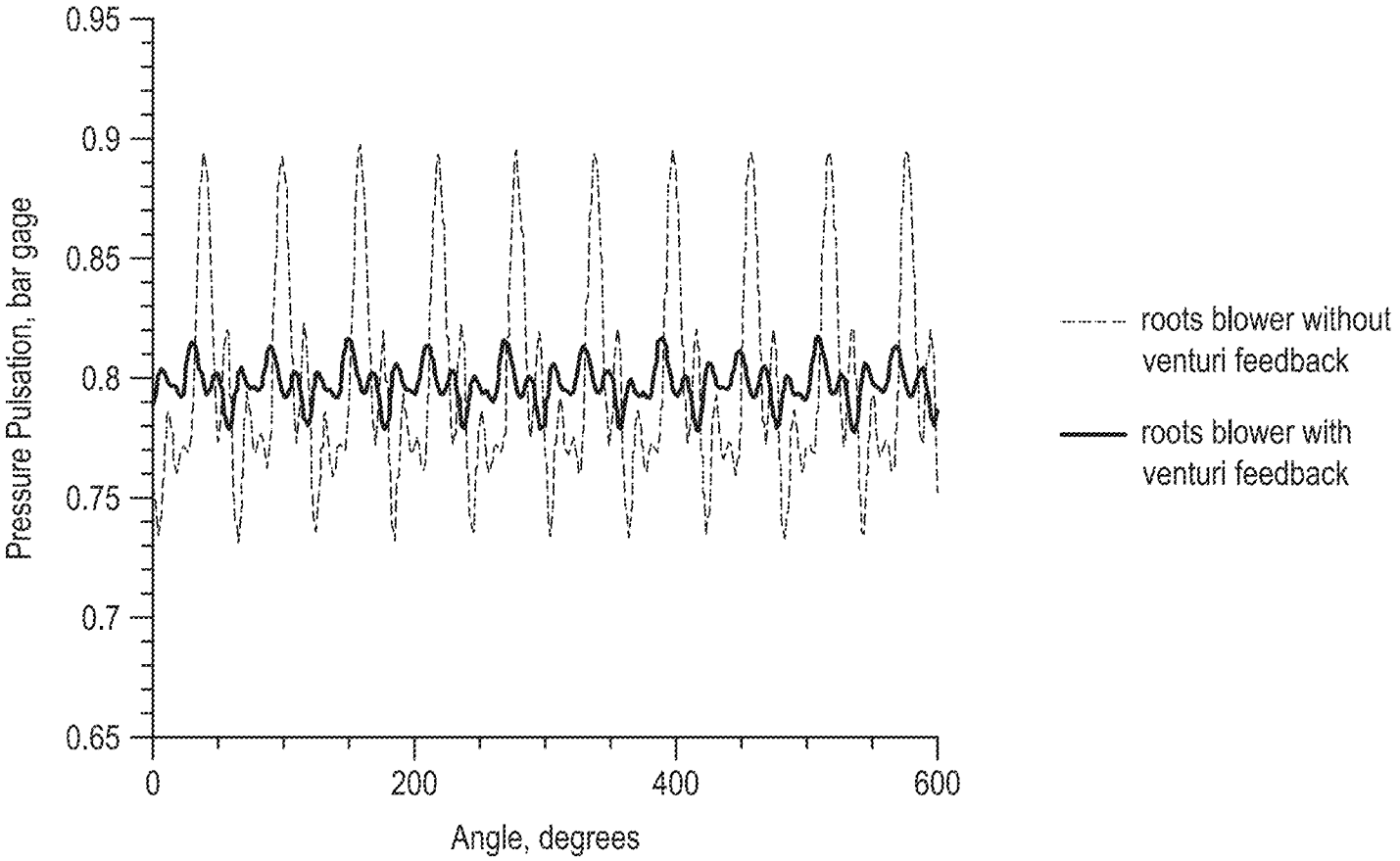
FIG. 9 is a graph illustrating pressure pulsation in bars gage versus angle in degrees showing a comparison of outlet dynamic pressures at points P4_Out' and P4_Out for the positive displacement blower illustrated in FIG. 1 and the positive displacement roots blower illustrated in FIG. 2, respectively.

Referring again to FIG. 2, the locations of measurement points for a computational fluid dynamics (CFD) analysis of the positive displacement roots blower with venturi feedback are shown. With reference to FIG. 1, the locations of measurement points for a CFD analysis of the positive displacement roots blower without venturi feedback are shown. As shown in FIG. 5, the pressure pulsation at point P1_In of the inlet of the roots blower of FIG. 2 is shown, compared to the pressure pulsation at P1_In' of the roots blower of FIG. 1. The pressure pulsations at the inlet of the roots blower of FIG. 2 are initially reduced by the presence of the air reservoir 88. This is because the air reservoir 88 adds fluid capacity where needed, so that the air flowing into the roots blower is no longer vacuumed into the inlet as in the roots blower of FIG. 1.

Referring to FIGS. 6 through 9, the pressure pulsations at the outlets of the roots blower with the venturi feedback are shown at points P1_Out, P2_Out, P3_Out, and P4_Out compared respectively with points P1_Out', P2_Out', P3_Out', and P4_Out' of the roots blower without the venturi feedback. In these cases, the pressure pulsations, measured in bars, are decreased significantly in the roots blower with the venturi feedback, with the lowest levels of pulsation near point P4_Out of the discharge of the compressor where a silencer (not shown) may typically be positioned.

Figure 10A:
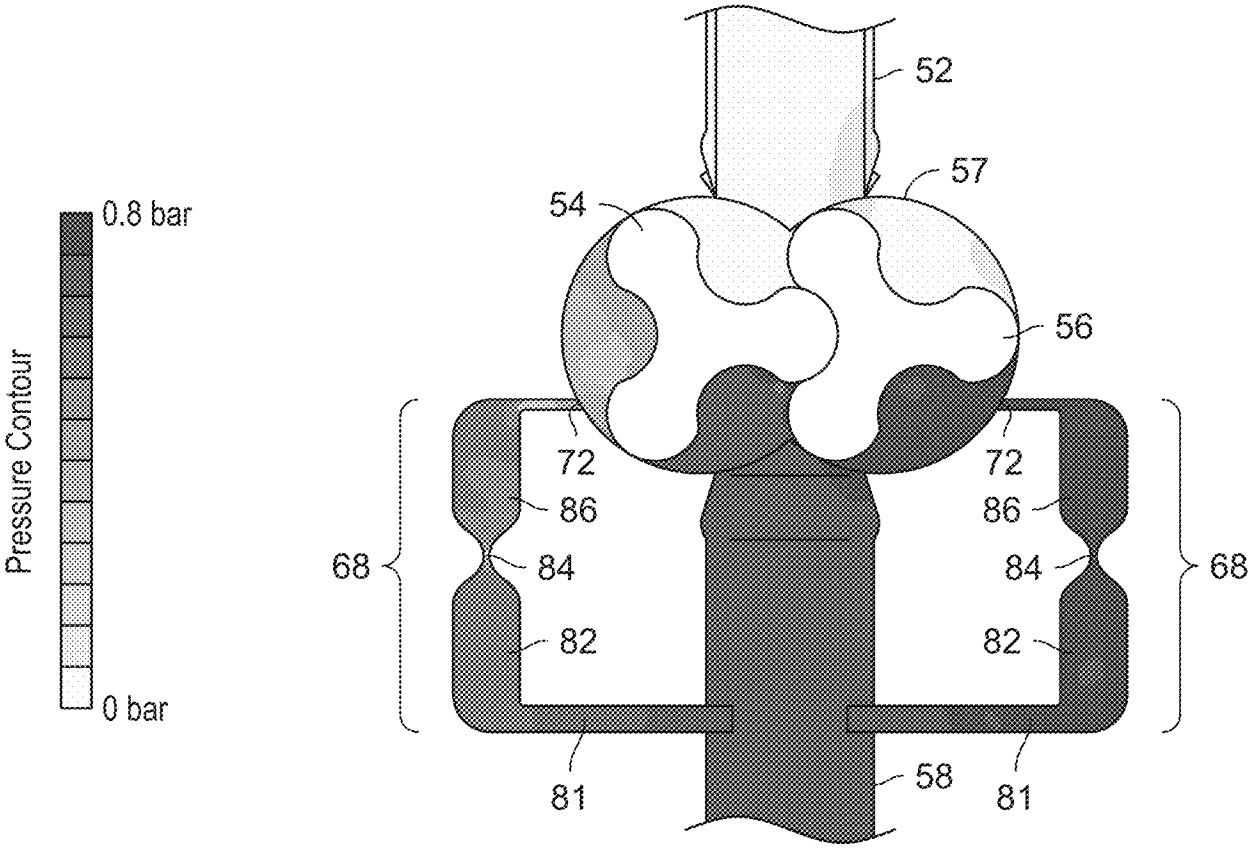
FIG. 10A is a diagrammatic illustration of pressure inside a pocket of a positive displacement roots blower, such as the positive displacement roots blower illustrated in FIG. 2, where a rotor is shown at an initial rotational orientation in accordance with examples of the present disclosure.
Figure 10B:
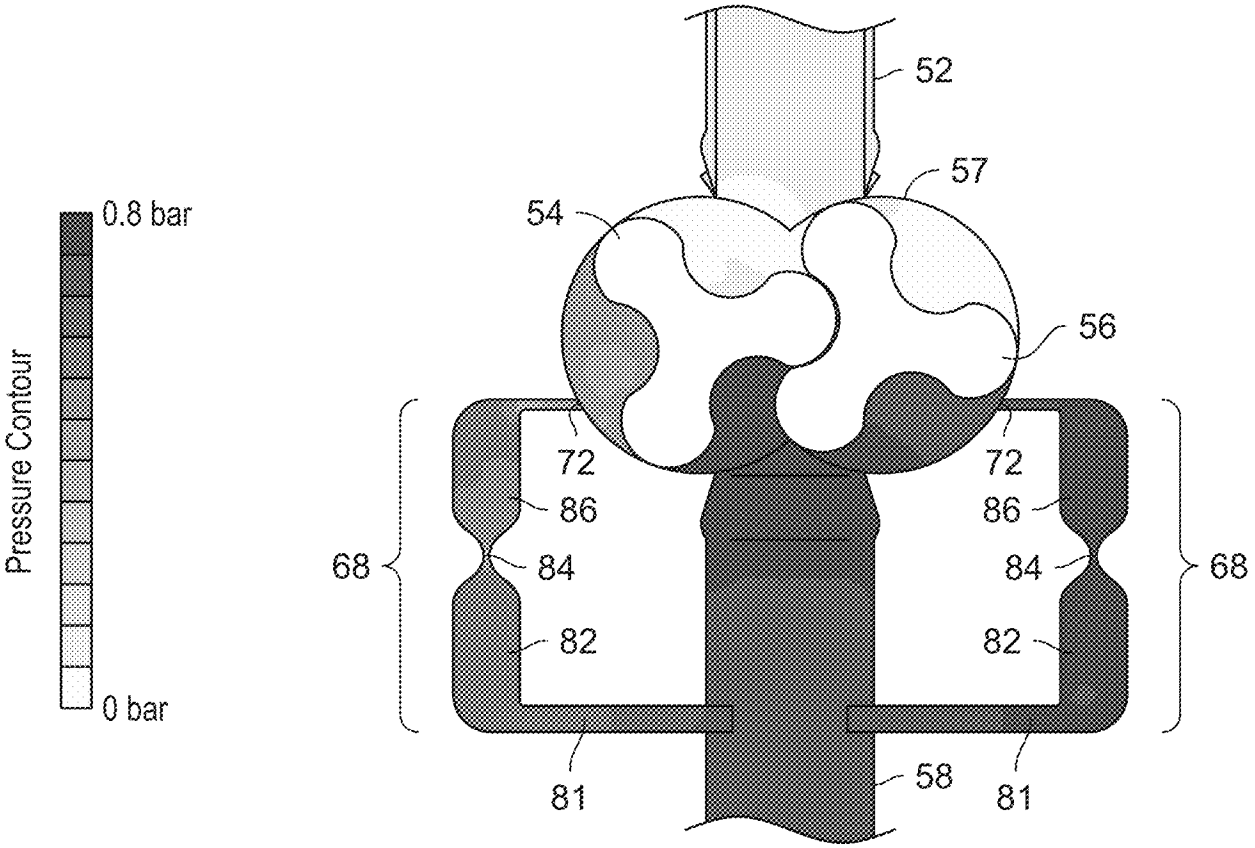
FIG. 10B is a diagrammatic illustration of the pressure inside the pocket of the positive displacement roots blower of FIG. 10A, where the rotor is shown at a rotational orientation ten degrees (10°) from the initial rotational orientation.

Turning now to FIGS. 10A-10H, computational results are shown comparing the pressure inside the pockets at different orientations of the of lobes as the rotors 54 and 56 of the roots blower with venturi feedback of FIG. 1 rotate, starting at a relative angle of 0 degrees of the rotors in FIG. 10A and progressing in 10 degree increments throughout the remainder of FIGS. 10B-10H. The angle measurements shown in FIGS. 10A-10H are for convenience of illustration and do not correspond precisely to the measurements provided herein with respect to location of inlets and outlets as will be understood in the context of the description. In other words, 0 degrees in FIG. 10A does not necessarily correspond to the 12 o'clock position described above.

Figure 10C:
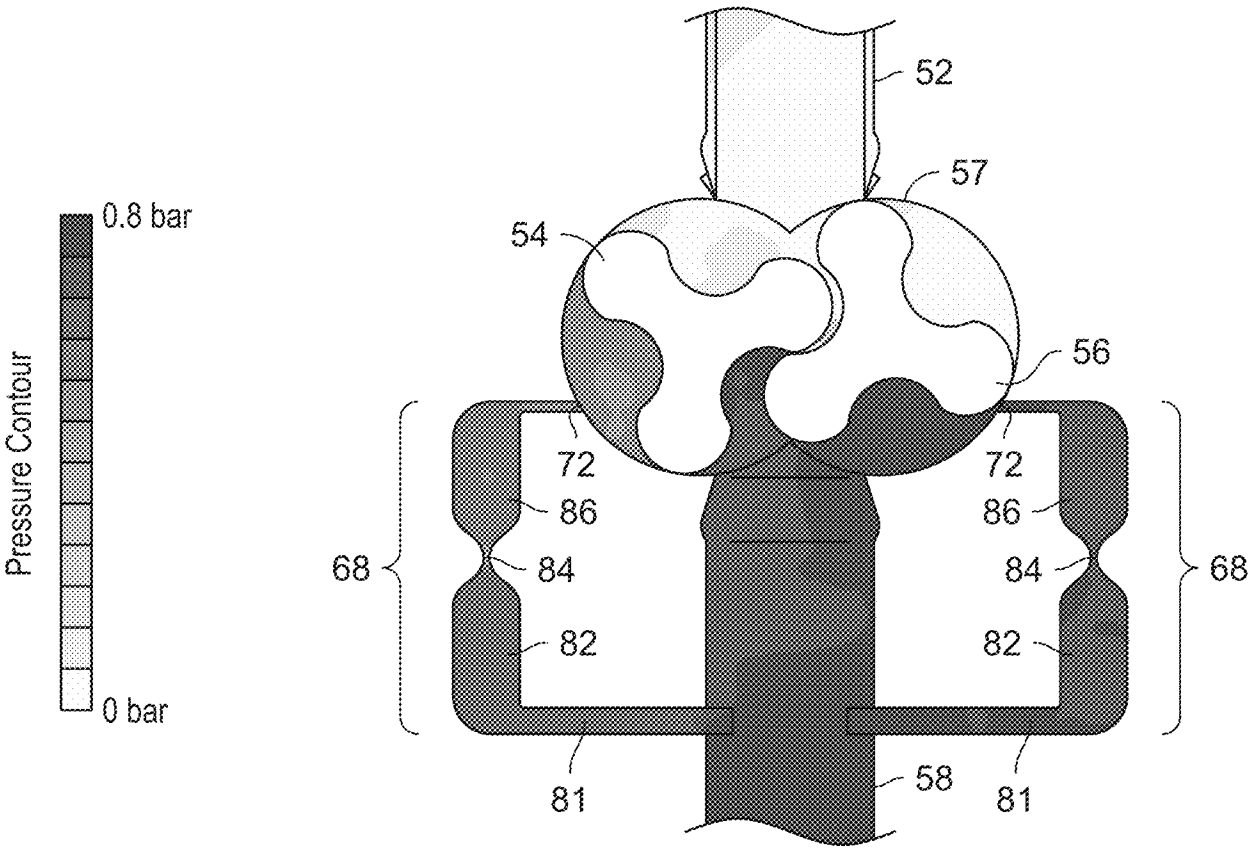
FIG. 10C is a diagrammatic illustration of the pressure inside the pocket of the positive displacement roots blower of FIG. 10A, where the rotor is shown at a rotational orientation twenty degrees (20°) from the initial rotational orientation.
Figure 10D:
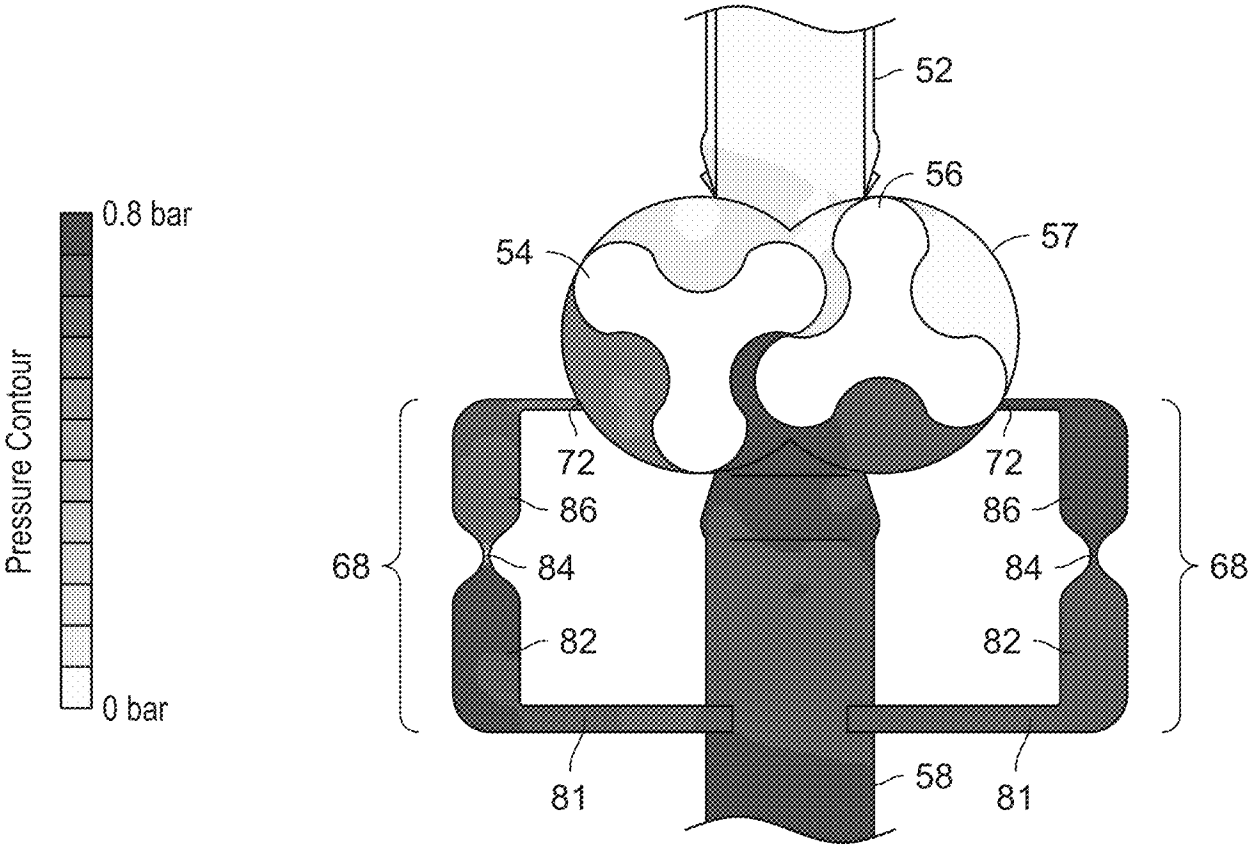
FIG. 10D is a diagrammatic illustration of the pressure inside the pocket of the positive displacement roots blower of FIG. 10A, where the rotor is shown at a rotational orientation thirty degrees (30°) from the initial rotational orientation.
Figure 10E:
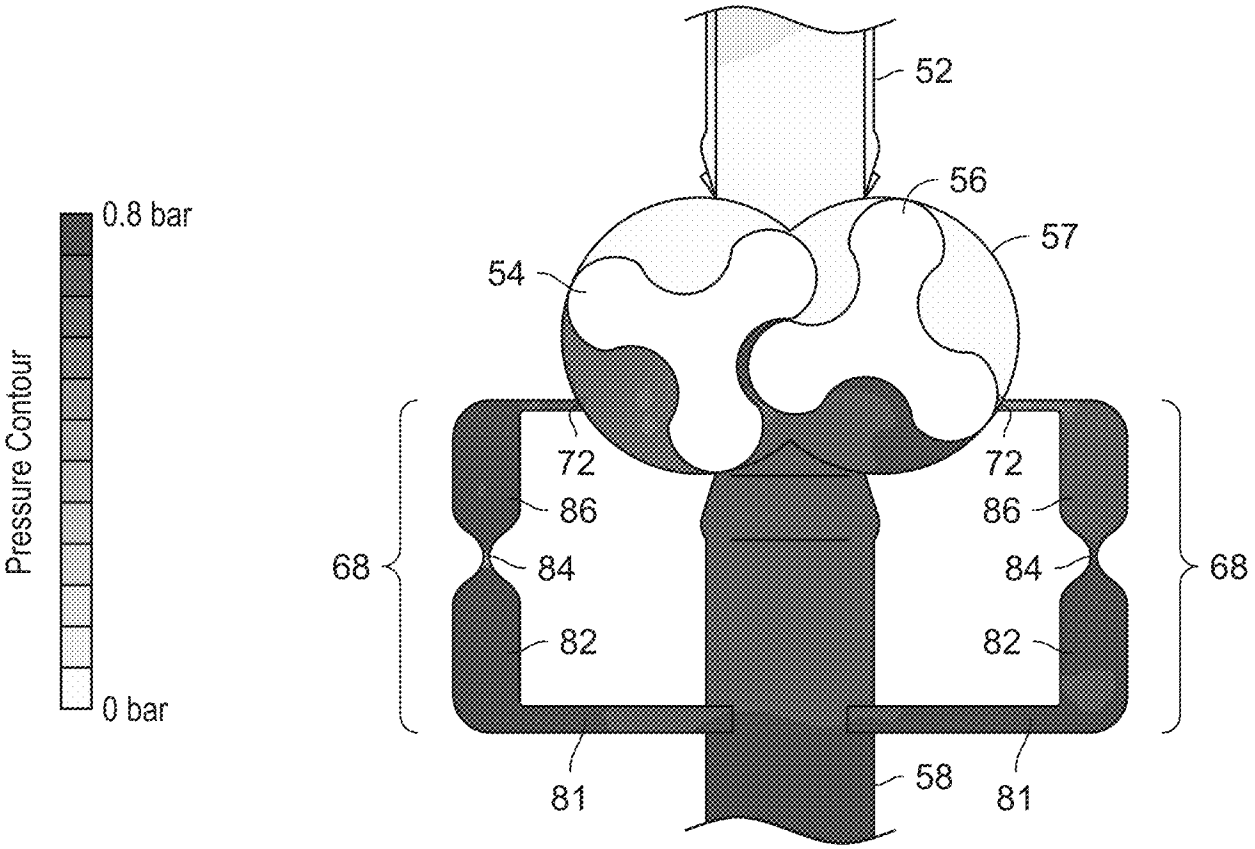
FIG. 10E is a diagrammatic illustration of the pressure inside the pocket of the positive displacement roots blower of FIG. 10A, where the rotor is shown at a rotational orientation forty degrees (40°) from the initial rotational orientation.
Figure 10F:
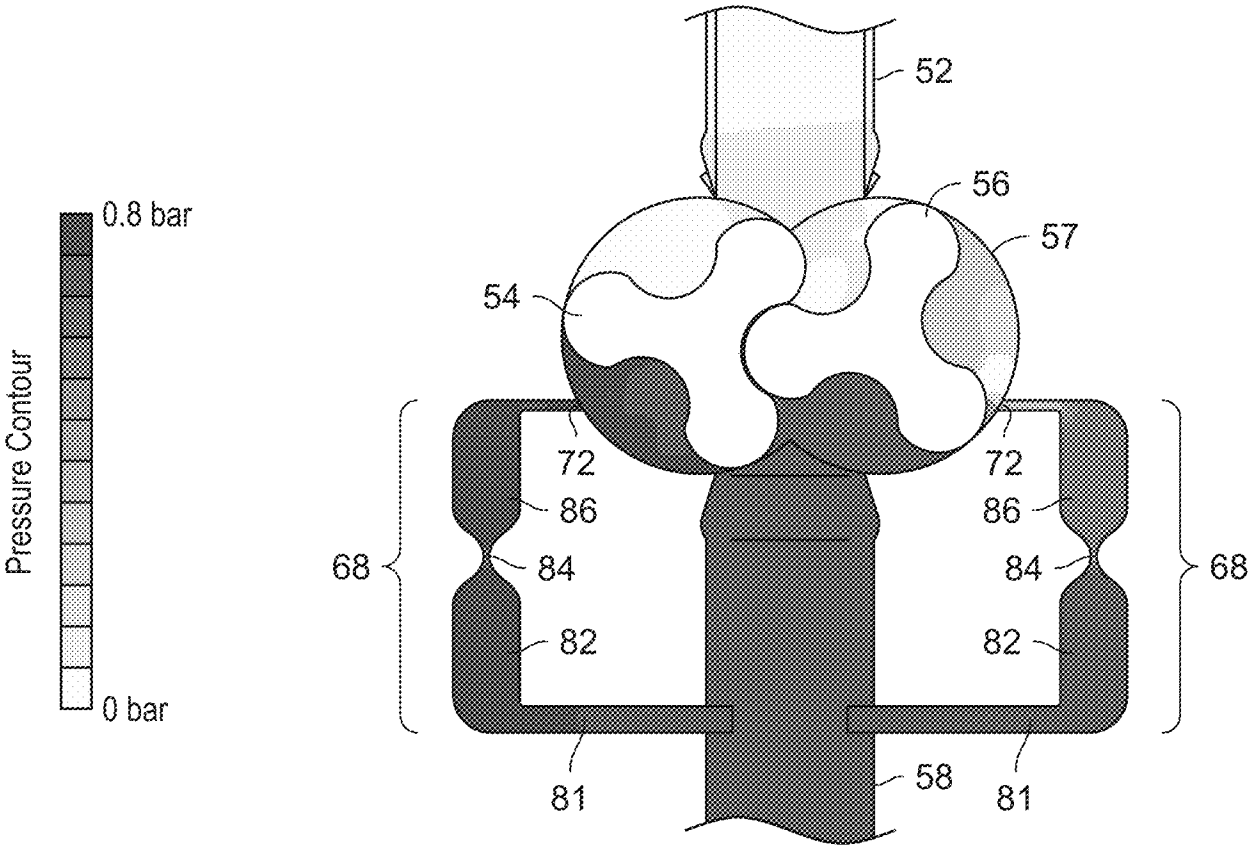
FIG. 10F is a diagrammatic illustration of the pressure inside the pocket of the positive displacement roots blower of FIG. 10A, where the rotor is shown at a rotational orientation fifty degrees (50°) from the initial rotational orientation.
Figure 10G:
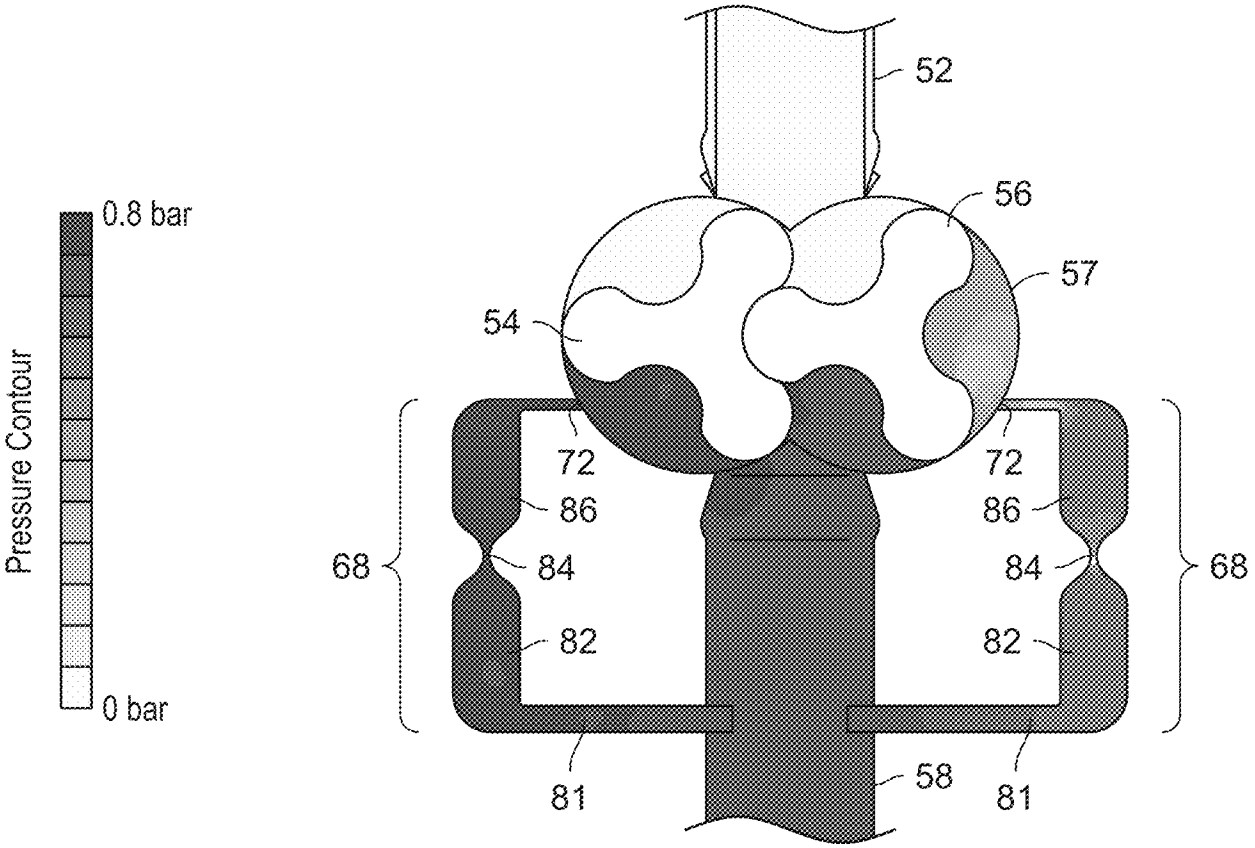
FIG. 10G is a diagrammatic illustration of the pressure inside the pocket of the positive displacement roots blower of FIG. 10A, where the rotor is shown at a rotational orientation sixty degrees (60°) from the initial rotational orientation.
Figure 10H:
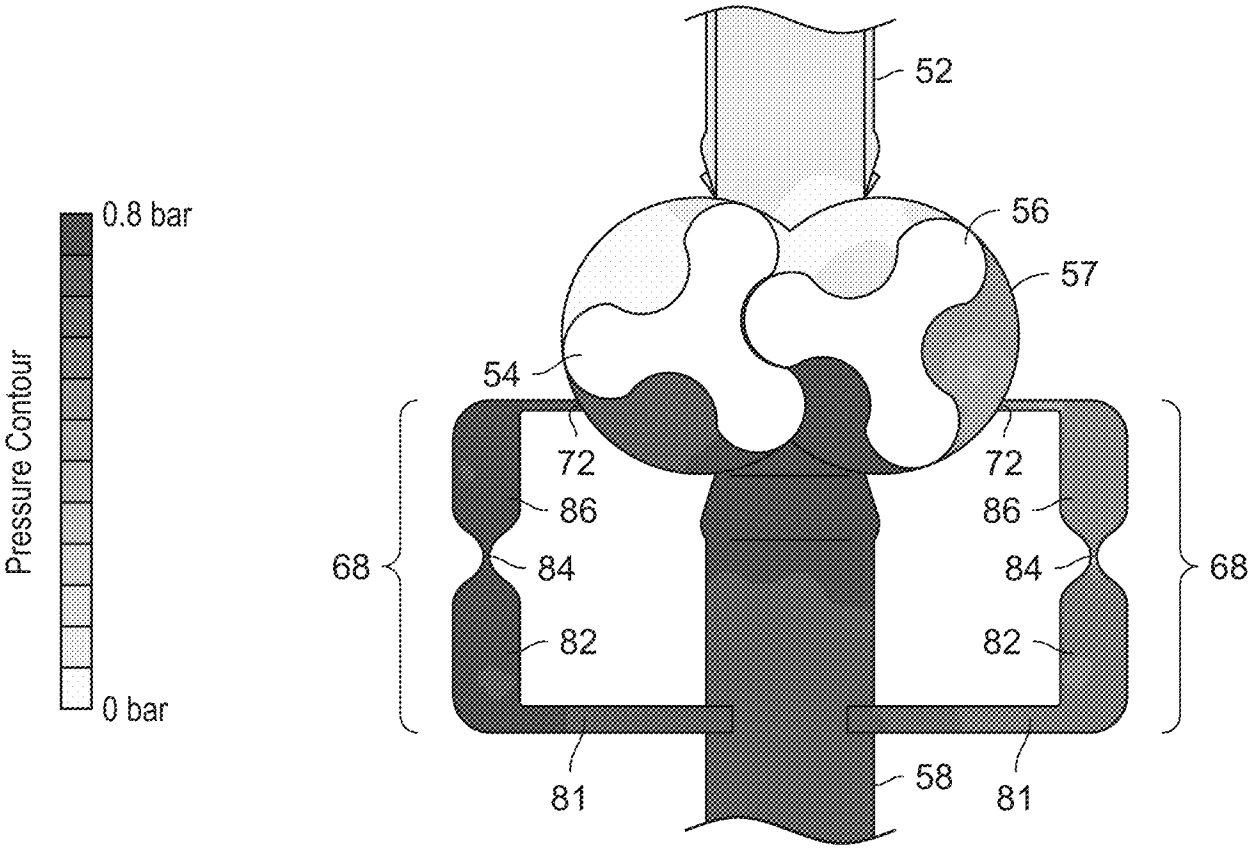
FIG. 10H is a diagrammatic illustration of the pressure inside the pocket of the positive displacement roots blower of FIG. 10A, where the rotor is shown at a rotational orientation seventy degrees (70°) from the initial rotational orientation.
Figure 11C:
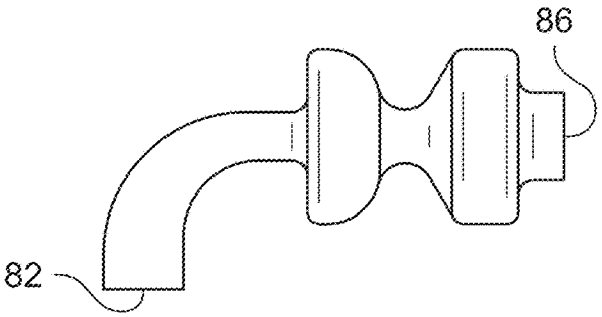
FIG. 11C is a side view illustrating a further flow restricting geometry for a positive displacement roots blower, such as the positive displacement roots blower illustrated in FIG. 2, in accordance with examples of the present disclosure.
Figure 11B:
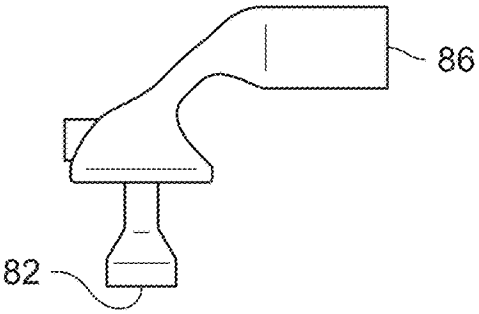
FIG. 11B is a side view illustrating another flow restricting geometry for a positive displacement roots blower, such as the positive displacement roots blower illustrated in FIG. 2, in accordance with examples of the present disclosure.
Figure 11A:
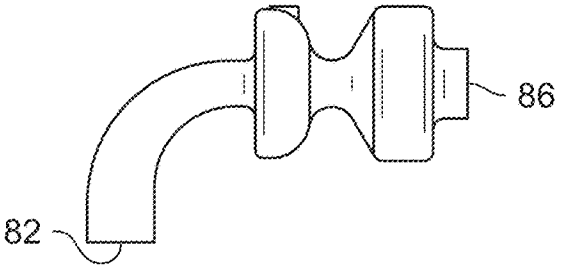
FIG. 11A is a side view illustrating a flow restricting geometry for a positive displacement roots blower, such as the positive displacement roots blower illustrated in FIG. 2, in accordance with examples of the present disclosure.
Figure 11E:
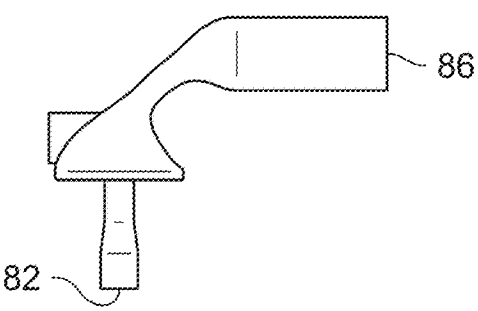
FIG. 11E is a side view illustrating a further flow restricting geometry for a positive displacement roots blower, such as the positive displacement roots blower illustrated in FIG. 2, in accordance with examples of the present disclosure.
Figure 11D:
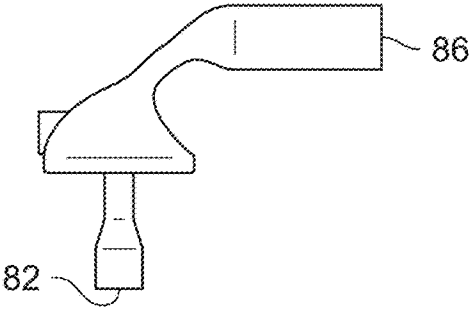
FIG. 11D is a side view illustrating another flow restricting geometry for a positive displacement roots blower, such as the positive displacement roots blower illustrated in FIG. 2, in accordance with examples of the present disclosure.
Figure 11H:
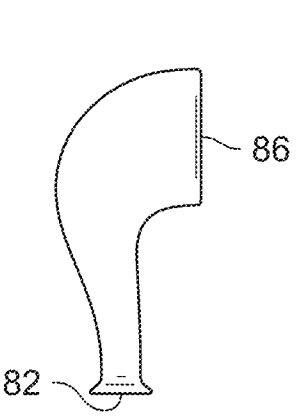
FIG. 11H is a side view illustrating another flow restricting geometry for a positive displacement roots blower, such as the positive displacement roots blower illustrated in FIG. 2, in accordance with examples of the present disclosure.
Figure 11G:
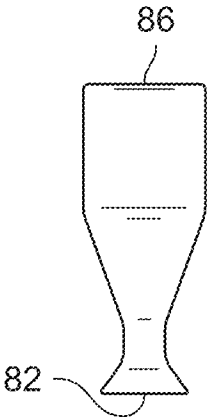
FIG. 11G is a side view illustrating a further flow restricting geometry for a positive displacement roots blower, such as the positive displacement roots blower illustrated in FIG. 2, in accordance with examples of the present disclosure.
Figure 11F:
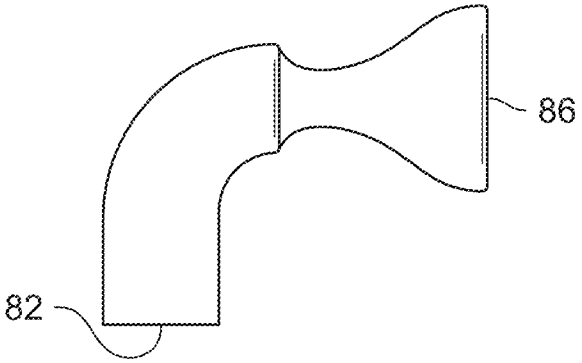
FIG. 11F is a side view illustrating another flow restricting geometry for a positive displacement roots blower, such as the positive displacement roots blower illustrated in FIG. 2, in accordance with examples of the present disclosure.
Figure 11K:
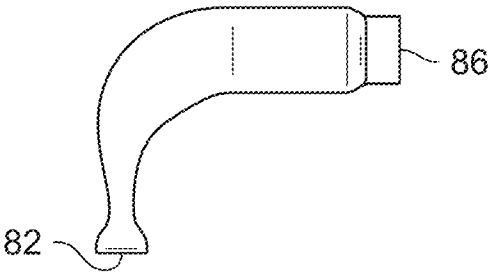
FIG. 11K is a side view illustrating another flow restricting geometry for a positive displacement roots blower, such as the positive displacement roots blower illustrated in FIG. 2, in accordance with examples of the present disclosure.
Figure 11J:
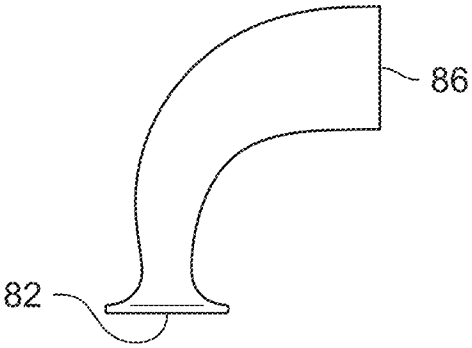
FIG. 11J is a side view illustrating a further flow restricting geometry for a positive displacement roots blower, such as the positive displacement roots blower illustrated in FIG. 2, in accordance with examples of the present disclosure.

The 0 degrees indication in FIG. 10A illustrates a position in which the rotor 56 is about to sweep past the inlet 52 and thereby close off and form a pocket between adjacent lobes of the rotor 56 (as shown in FIG. 10C) which will be moved to the outlet 58 upon further rotation of the rotor 56. Once the pocket is rotated to the outlet 58 any residual gas within the pocket can be vented, before the rotor 56 is rotated into intermeshed engagement with rotor 54 and the process begins anew. FIG. 10F shows rotor 54 venting the residual gas within the pocket to the outlet 58. It will be appreciated that the pressure in the pocket is lower than pressure of a gas at the outlet 58 in some modes of operation, while in other modes of operation, the pocket can be at a similar pressure to pressure of gas at the outlet at the moment of venting.

As will be appreciated given the discussion above, the rotors 54 and 56 rotate through several regions which can be characterized by the location of its pocket and whether the pocket is in fluid communication with any respective passage such as the inlet 52, venturi feedbacks 68, and outlet 58. Region (1) can be characterized by the pocket being open to inlet 52, closed to venturi feedback inlet 72, and closed to outlet 58. Region (2) can be characterized by the pocket being closed to inlet 52, open to the venturi feedback inlet 72, and closed to outlet 58. When the pocket is in Region (2), the rotors are located in a pressure equalization position, where adjacent lobes form the pocket open to the venturi feedback inlet 72. For example, the pressure equalization position forms when a trailing lobe of the adjacent lobes traverses and angle between 5 and 15 degrees after the inlet is closed. Region (3) can be characterized as the pocket being closed to inlet 52, closed to venturi feedback inlet 72, and open to outlet 58.

The arc length of travel associated with the rotors 54 and 56 in which the venturi feedback 68 increases the pressure of the pocket, and where over that arc length the pocket is sealed from the inlet 52 and the outlet 58 by virtue of the position of the rotor within the volume (e.g. Region (2)) can be about 35 degrees in some examples, while in other examples it can be about 40, 45, 50, 55, 60, 65, 70, and 75 degrees, and in some examples can be up to about 90 degrees. For example, different arc lengths of travel are contemplated depending on whether the rotor 56 is a three lobed or four lobed rotor (or possibly a rotor having other numbers of lobes). It will be appreciated that the term "sealed" as used in this context includes those situations in which the rotor may not be perfectly contacted along the entirely of the surface and instead may include a lift or other imperfection of contact that permits a small to negligible amount of gas to leak past. It can of course also include those circumstances in which a perfect fluid tight seal is formed.

The location of the upstream edge of the venturi inlet 72 of the venturi feedback 68 into the pocket can be anywhere between at least 60 degrees and at least 120 degrees from the 12 o'clock position, and in some examples can be greater than 120 degrees. In some examples, the venturi inlet 72 can be positioned to higher angles up to 170 degrees. To set forth just a few nonlimiting example, the angular position range between about 90, 95, 100, 105, 110, 115, 120, 125, 130, 135, 140, 145, and 150 degrees and about 90, 95, 100, 105, 110, 115, 120, 125, 130, 135, 140, 145, and 150 degrees.

In some examples, the venturi feedback inlet 72 is structured as an elongated entry to the respective pockets contained between the rotors 54 and 56 and the housing 57, and the venturi inlet 72 may be positioned between about 100 degrees and about 140 degrees from a 12 o'clock position.

In some examples, region (2) may occur over an arc length of rotation of one of the intermeshed rotating members of at least 35 degrees. In examples of the present application, region (2) could occur over an arc length of rotation of one of the intermeshed rotating members of at least 60 degrees.

It will be appreciated that while hourglass-shaped cross-sectional area restriction venturi feedbacks have been described above and shown in the accompanying figures with some specificity, other shapes of cross-sectional area restrictions can be used with positive displacement roots blower devices in accordance with examples of the present disclosure. These shapes can include but are not necessarily limited to shapes as shown in FIGS. 11A-11H and 11J-11K. Additionally, a mechanical valve may be used in place of a cross-sectional area restriction as a flow restricting device. In some examples, one or more of the passages connecting the operating volumes to the restriction can be connected to a pressure of the outlet. In examples, one or more of the passages connecting the operating volumes to the restriction can be connected to an external pressure (e.g., atmospheric pressure).

Figure 12:
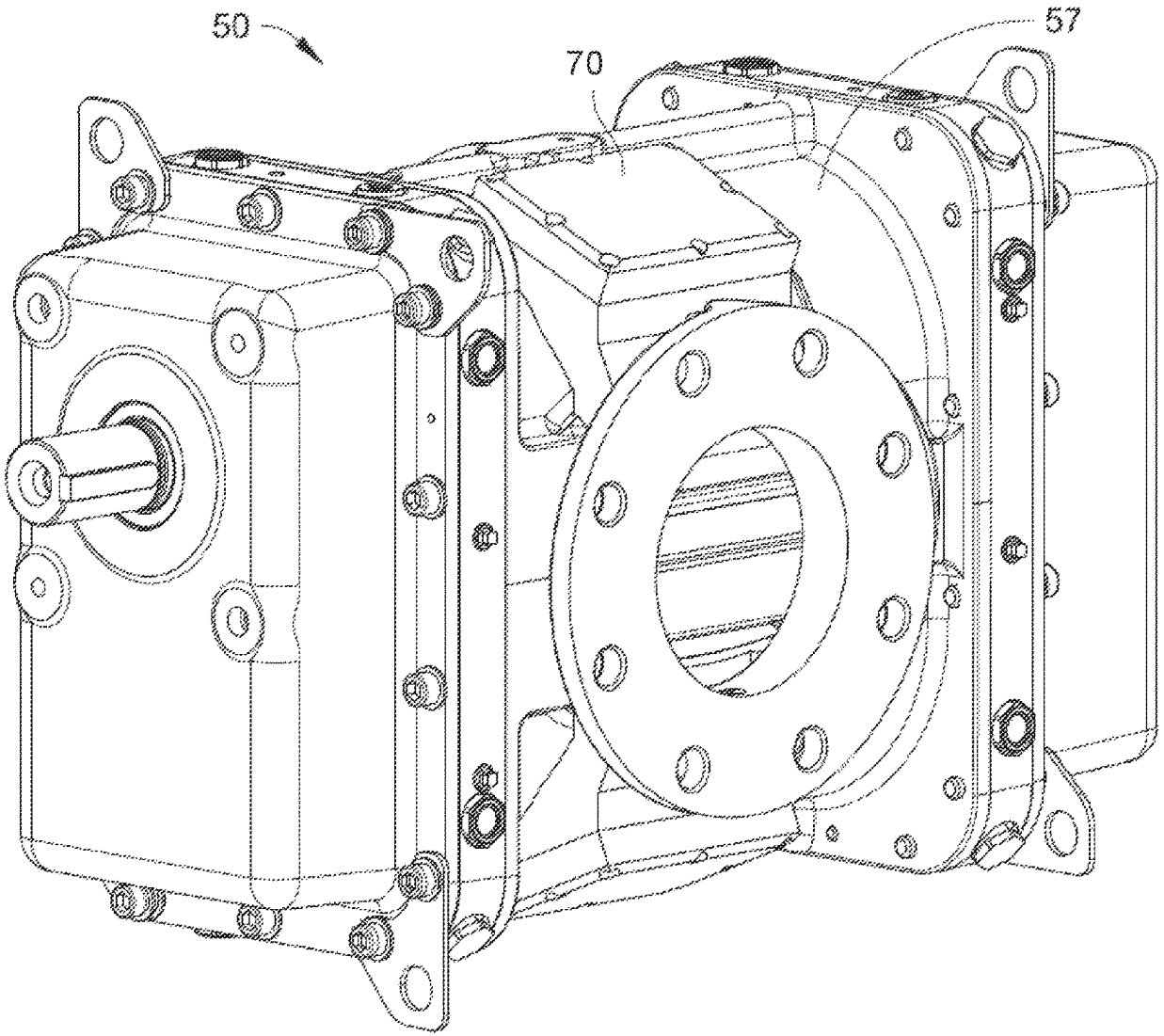
FIG. 12 is a perspective view illustrating a positive displacement roots blower, such as the positive displacement roots blower illustrated in FIG. 2, in accordance with examples of the present disclosure.
Figure 13:
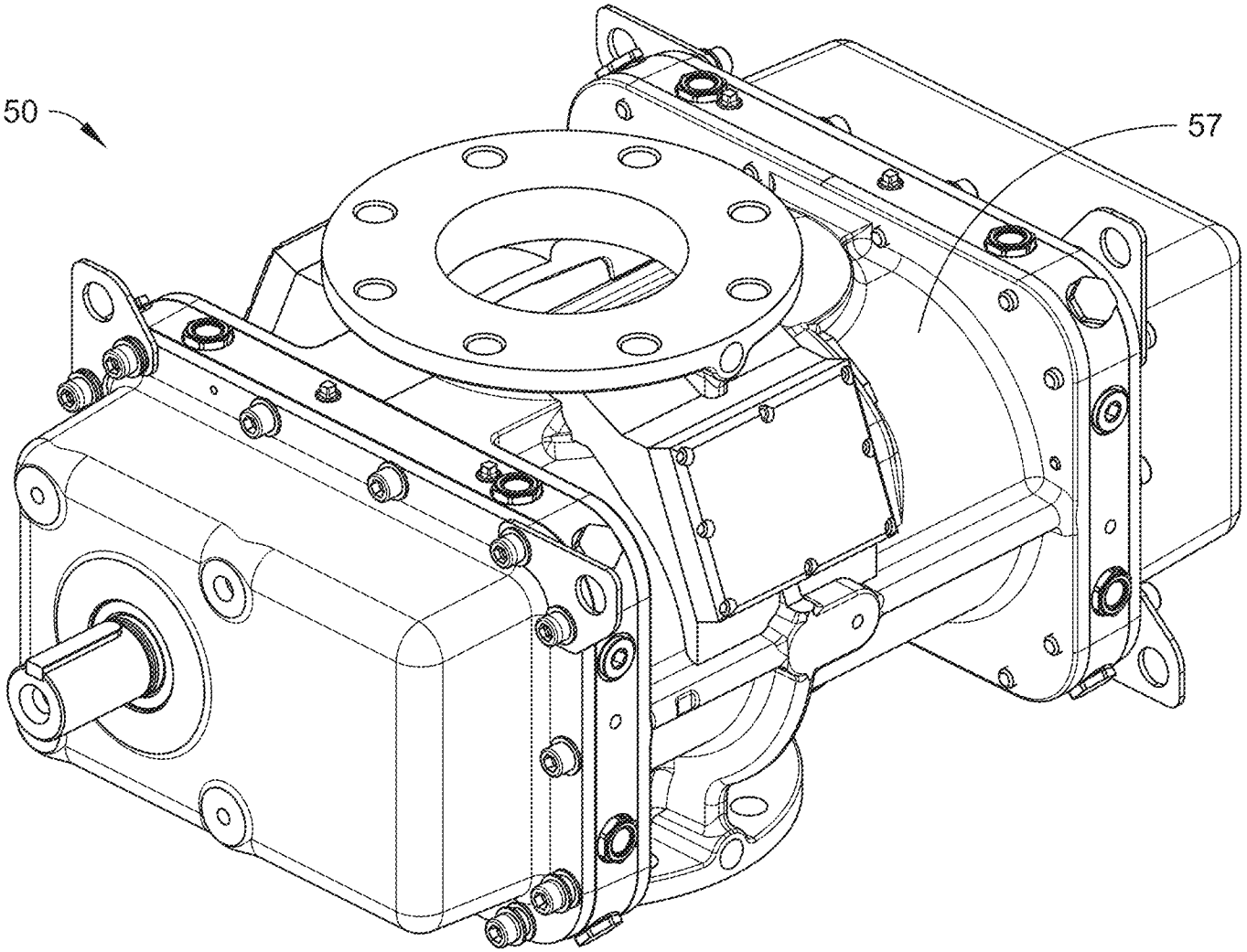
FIG. 13 is another perspective view of the positive displacement roots blower illustrated in FIG. 12.
Figure 14:
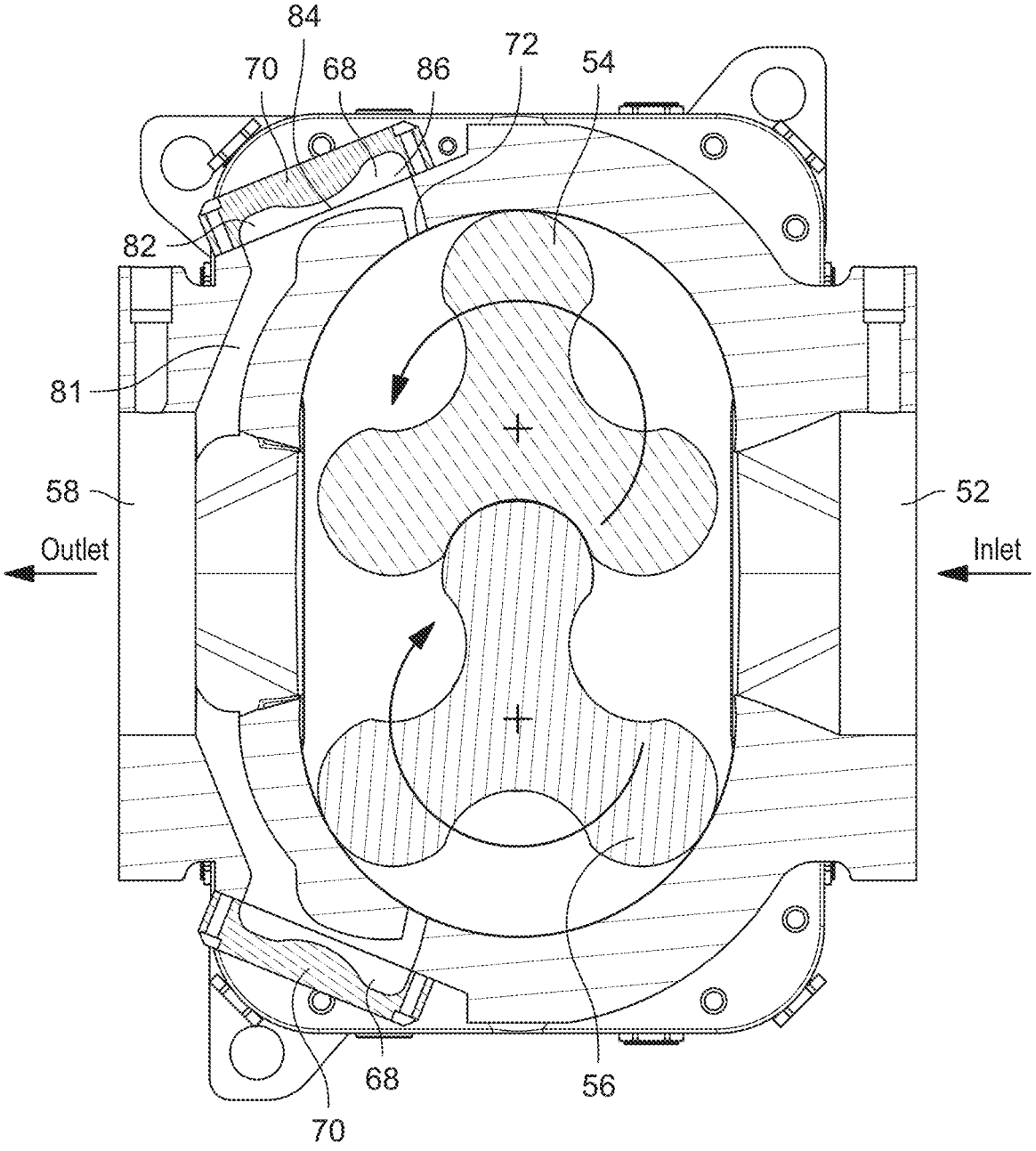
FIG. 14 is a partial cross-sectional side elevation view of a positive displacement roots blower, such as the positive displacement roots blower illustrated in FIG. 2, in accordance with examples of the present disclosure.
Figure 15:
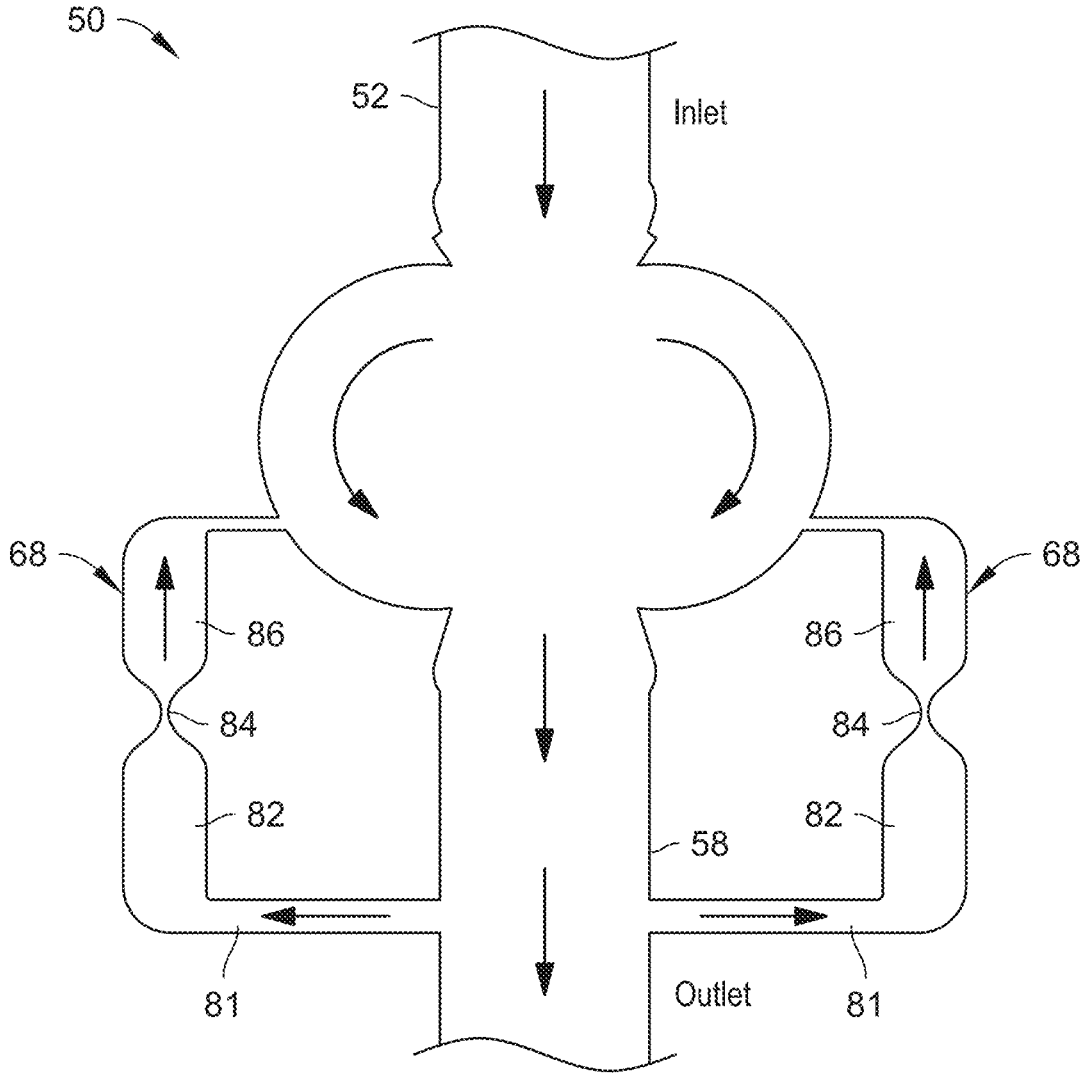
FIG. 15 is a cross-sectional side view of a positive displacement roots blower, such as the positive displacement roots blower illustrated in FIG. 2, where airflow through the roots blower is shown in accordance with examples of the present disclosure.

Referring to FIGS. 12 through 14, a housing 57 for a positive displacement roots blower that includes venturi feedback loops is shown in accordance with examples of the present disclosure. Housing 57 includes venturi housing 70, which contains the venturi feedback 68 between the outlet 58 and the inner surface of housing 57. The venturi feedback 68 is shown in the cross-sectional view of housing 57 in FIG. 14. The fluid flows from right to left, entering at inlet 52 and flowing radially within housing 57 after being received between the respective lobes of rotors 54 and 56, before exiting through outlet 58 and partially flowing through venturi feedback 68. FIG. 15 is a diagrammatic illustration of airflow through a positive displacement roots blower with venturi feedbacks, e.g., as previously described.

Figure 16:
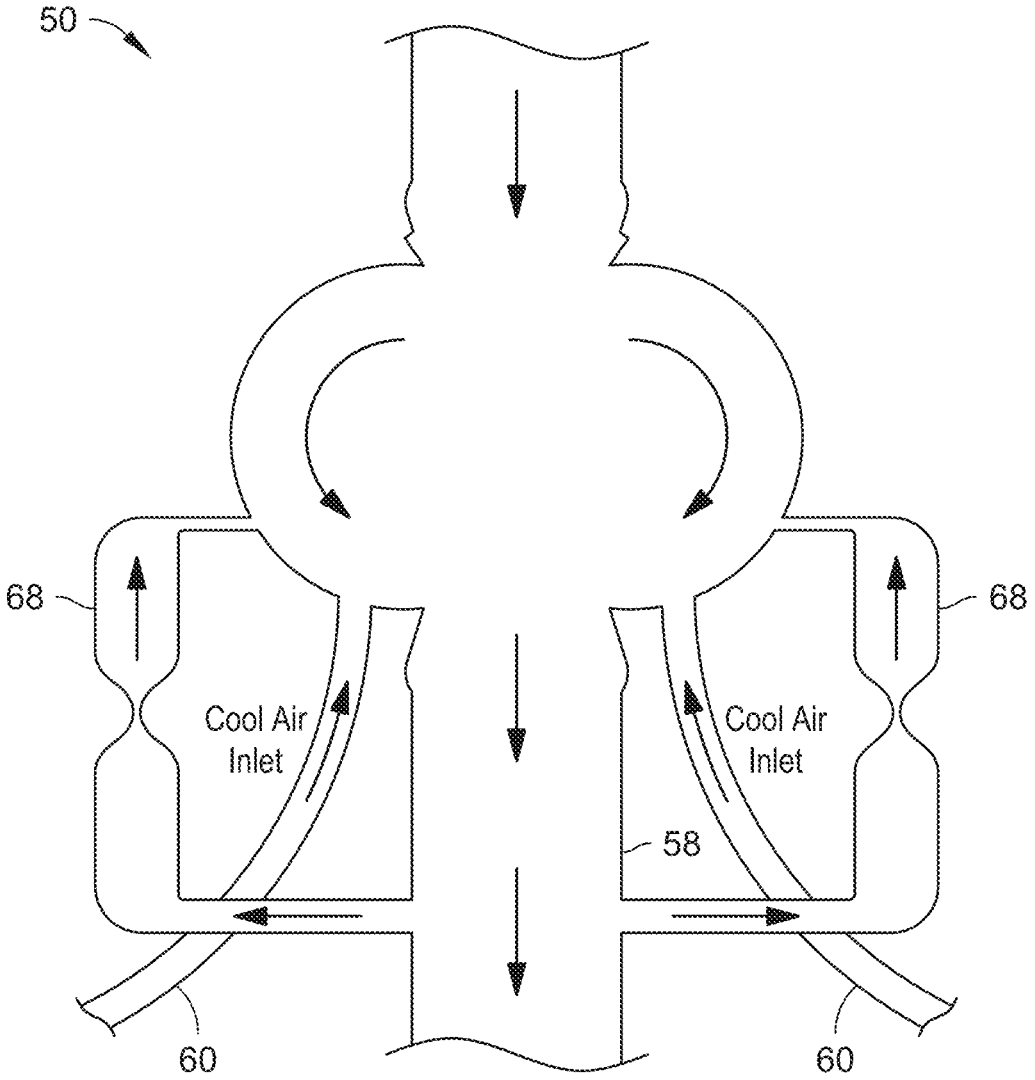
FIG. 16 is a cross-sectional side view of another positive displacement roots blower with a cold air inlet, where airflow through the roots blower is shown in accordance with examples of the present disclosure.

Some examples of positive displacement roots blowers that include venturi feedback loops may also include a cold air inlet, such as the cold air inlet 60 depicted in FIG. 16 and/or in U.S. Pat. No. 10,851,788, which is hereby incorporated by reference in its entirety. The cold air inlet can be used to reduce the temperature of air exiting the outlet 58. It will be appreciated that any other suitable cooling gas can be used rather than air. In some examples, a positive displacement roots blower as described with reference to FIG. 16 may also include an air reservoir, such as the air reservoir 88 described with reference to FIG. 2, proximate to the air inlet 52 to feed air into the pockets formed between adjacent lobes of respective rotors 54 and 56.

While the subject matter has been illustrated and described in detail in the drawings and foregoing description, the same is to be considered as illustrative and not restrictive in character, it being understood that only the preferred examples have been shown and described and that all changes and modifications that come within the spirit of the subject matters are desired to be protected. It should be understood that while the use of words such as preferable, preferably, preferred or more preferred utilized in the description above indicate that the feature so described may be more desirable, it nonetheless may not be necessary and examples lacking the same may be contemplated as within the scope of the subject matter, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A positive displacement roots blower comprising:

a housing having:

an inlet structured to receive an incoming flow of a compressible fluid, an outlet structured to exhaust an outgoing flow of the compressible fluid from the housing, a cavity defined by the housing, the cavity fluidly coupled to the inlet and the outlet, and a venturi feedback including a connecting tube, a venturi, and a venturi feedback inlet, the connecting tube in fluid communication with the outlet and the venturi, the connecting tube configured to divert a portion of the outgoing flow from the outlet, the venturi feedback inlet in fluid communication with the venturi and the cavity, wherein the venturi defines a first chamber, a second chamber, and a constricted section formed therebetween, the first chamber and the second chamber having a flow-path cross-section that is larger than a flow-path cross-section of the connecting tube and the venturi feedback inlet, respectively; and a pair of intermeshed rotors supported for complementary rotation within the cavity of the housing, the rotors and housing forming respective operating volumes there between which rotate with the rotor;

wherein the venturi feedback increases pressure inside the operating volumes prior to the rotors discharging the outgoing fluid through the outlet.

2. The positive displacement roots blower of claim 1, wherein each of the respective operating volumes have the following regions: open to the inlet/closed to the venturi feedback inlet/closed to the outlet; closed to the inlet/open to the venturi feedback inlet/closed to the outlet; and closed to the inlet/closed to the venturi feedback inlet/open to the outlet.

3. The positive displacement roots blower of claim 1, wherein the venturi feedback inlet is structured as an elongated entry to the respective operating volumes.

4. The positive displacement roots blower of claim 3, wherein the venturi feedback inlet is positioned between 100 degrees and 140 degrees from a 12 o'clock position.

5. The positive displacement roots blower of claim 4, wherein the region where the operating volume is closed to the inlet/open to the venturi feedback inlet/closed to the outlet occurs over an arc length of rotation of one of the intermeshed rotors of at least 35 degrees.

6. The positive displacement roots blower of claim 5, wherein the region where the operating volume is closed to the inlet/open to the venturi feedback inlet/closed to the outlet occurs over an arc length of rotation of one of the intermeshed rotors of at least 60 degrees.

7. The positive displacement roots blower of claim 5, wherein the operating volume is at a pressure equal to a static pressure in the outlet as the operating volume transitions from the region where the operating volume is closed to the inlet/open to the venturi feedback inlet/closed to the outlet to the region closed to the inlet/closed to the venturi feedback inlet/open to the outlet.

8. The positive displacement roots blower of claim 1, wherein the housing further includes an air reservoir located proximate to the inlet for furnishing air to the operating volume.

9. The positive displacement roots blower of claim 8, wherein the volume of the air reservoir is at least approximately equal to the volume of the operating volume to be filled.

10. The positive displacement roots blower of claim 8, wherein the volume of the air reservoir is greater than the volume of the operating volume to be filled.

11. An apparatus comprising:

a positive displacement roots blower having a pair of counter rotational rotors structured to be cooperatively engaged and interengagingly rotated, each of the pair of counter rotational rotors having a plurality of respective lobes;

an inlet structured to provide a compressible fluid to an intake side of the positive displacement roots blower;

an outlet positioned opposite the inlet and structured to discharge the compressible fluid; and a pair of feedback loops having respective feedback loop inlets, venturis, and connecting tubes, the connecting tubes configured to divert a portion of the discharged compressible fluid from the outlet, the feedback loop inlets open to the positive displacement roots blower, the pair of feedback loops disposed on opposing sides of the positive displacement roots blower and structured to increase a pressure between operating volumes between the plurality of lobes, each respective venturi defining a first chamber, a second chamber, and a constricted section formed therebetween, the first chamber and the second chamber having a flow-path cross-section that is is larger than a flow-path cross-section of the respective connecting tube and the respective feedback loop inlet;

wherein each of the pair of counter rotational rotors rotates to a pressure equalization position in which adjacent lobes form a volume which is in fluid communication with a respective one of the pair of feedback loop inlets and in which the volume formed by the adjacent lobes in the pressure equalization position is not in fluid communication with either of the inlet and the outlet.

12. The apparatus of claim 11, wherein the feedback loops comprise a convergent-divergent passage having a throat, the throat forming a restriction.

13. The apparatus of claim 11, wherein the feedback loop inlets are in the form of elongate openings in the positive displacement roots blower, the elongate openings in fluid communication with the volume when each of the pair of counter rotational rotors are in the pressure equalization position.

14. The apparatus of claim 13, wherein the volume is formed over an angular range of motion of the adjacent lobes of at least 45 degrees.

15. The apparatus of claim 14, wherein the pressure equalization position of the adjacent lobes form the volume open to the feedback loop when a trailing lobe of the adjacent lobes traverses an angle between 5 and 15 degrees after the inlet is closed.

16. The apparatus of claim 11, wherein the positive displacement roots blower further includes a cooling air inlet disposed between the feedback loop inlet and the outlet, and wherein the feedback loop can be routed from a cooling air duct which feeds cooling air to the cooling air inlet.

17. A method of reducing pressure pulsation in a positive displacement roots blower comprising:

rotating a first rotor of a pair of intermeshed first and second rotors associated with the positive displacement roots blower, the positive displacement roots blower having a housing, an inlet, an outlet, and a passage connected to the outlet;

increasing the pressure of a volume created between adjacent lobes of the first rotor when the first rotor passes a venturi feedback loop inlet connected to the passage, the inlet and the outlet blocked by the adjacent lobes when the volume is in communication with the venturi feedback loop inlet connected to the outlet, wherein a venturi having a venturi ingress, a constricted section, and a venturi egress, is disposed between the venturi feedback loop inlet and the passage, a connecting tube in fluid communication with the venturi ingress and the passage, the connecting tube diverting a portion of fluid from the passage, wherein the venturi ingress and the venturi egress have a flow-path cross-section that is larger than a flow-path cross-section of a connecting tube and the venturi feedback loop inlet, respectively.

18. The method of claim 17, comprising rotating the first rotor through each of the following regions: open to the inlet/closed to the venturi feedback loop inlet/closed to the outlet; closed to the inlet/open to the venturi feedback loop inlet/closed to the outlet; and closed to the inlet/closed to the venturi feedback loop inlet/open to the outlet.

19. The method of claim 17, further comprising increasing the pressure of the volume created between adjacent lobes of the first rotor from atmospheric pressure when passing through the region open to the inlet/closed to the venturi feedback loop inlet/closed to the outlet to 1 bar atm when reaching the region closed to the inlet/closed to the venturi feedback loop inlet/open to the outlet.

20. The method of claim 17, further comprising positioning the venturi feedback loop inlet between 80 degrees and 140 degrees from a 12 o'clock position.

* * * * *